US011365700B2

(12) United States Patent
Yanoto et al.

(10) Patent No.: US 11,365,700 B2
(45) Date of Patent: Jun. 21, 2022

(54) FUEL INJECTION CONTROL DEVICE FOR INTERNAL COMBUSTION ENGINE

(71) Applicant: DENSO CORPORATION, Kariya (JP)

(72) Inventors: Keisuke Yanoto, Kariya (JP); Kazuya Kogo, Kariya (JP); Hatsumi Takeuchi, Kariya (JP)

(73) Assignee: DENSO CORPORATION, Kariya (JP)

( * ) Notice: Subject to any disclaimer, the term of this patent is extended or adjusted under 35 U.S.C. 154(b) by 30 days.

(21) Appl. No.: 16/693,745

(22) Filed: Nov. 25, 2019

(65) Prior Publication Data

US 2020/0088124 A1 Mar. 19, 2020

Related U.S. Application Data

(63) Continuation of application No. PCT/JP2018/020593, filed on May 29, 2018.

(30) Foreign Application Priority Data

May 30, 2017 (JP) ..... JP2017-107027

(51) Int. Cl.
*F02D 41/40* (2006.01)
*F02D 41/24* (2006.01)
(Continued)

(52) U.S. Cl.
CPC ..... *F02D 41/401* (2013.01); *F02D 41/2467* (2013.01); *F02D 41/40* (2013.01);
(Continued)

(58) Field of Classification Search
CPC ..... F02D 41/401; F02D 41/2467; F02D 2041/2055; F02D 2200/063; F02D 41/40;
(Continued)

(56) References Cited

U.S. PATENT DOCUMENTS

2014/0311459 A1* 10/2014 Katsurahara ..... F02D 41/30 123/478
2014/0366848 A1 12/2014 Fujii et al.
(Continued)

FOREIGN PATENT DOCUMENTS

WO WO-2015052915 A1 * 4/2015 ..... F02D 41/20

*Primary Examiner* — Phutthiwat Wongwian
*Assistant Examiner* — Susan E Scharpf
(74) *Attorney, Agent, or Firm* — Nixon & Vanderhye, PC

(57) ABSTRACT

An ECU opens a valve element to inject fuel in conjunction with energization of a fuel injection valve provided for an engine. The ECU includes an injection control unit, a characteristic acquisition unit, and a fuel injection correction unit. The injection control unit implements a partial-lift injection during which the valve element does not reach a full-lift position to open the fuel injection valve by an energization time. The characteristic acquisition unit acquires an actual lifting behavior of the valve element as an actual lift characteristic when the partial-lift injection is implemented. The fuel injection correction unit compares the actual lift characteristic acquired by the characteristic acquisition unit with a predetermined reference characteristic and corrects a fuel injection quantity in the partial-lift injection based on a result of the comparison.

14 Claims, 15 Drawing Sheets

(51) Int. Cl.

| | |
|---|---|
| ***F02M 51/00*** | (2006.01) |
| ***F02M 61/10*** | (2006.01) |
| ***F02D 41/20*** | (2006.01) |
| ***F02D 41/14*** | (2006.01) |

(52) U.S. Cl.
CPC ..... *F02M 51/00* (2013.01); *F02M 61/10* (2013.01); *F02D 41/14* (2013.01); *F02D 41/20* (2013.01); *F02D 2041/2055* (2013.01); *F02D 2200/063* (2013.01)

(58) Field of Classification Search
CPC ..... F02D 41/20; F02D 41/14; F02M 51/00; F02M 61/20; Y02T 10/40
See application file for complete search history.

(56) References Cited

U.S. PATENT DOCUMENTS

| | | | | |
|---|---|---|---|---|
| 2016/0237935 | A1* | 8/2016 | Tanaka | F02M 45/12 |
| 2016/0245211 | A1* | 8/2016 | Katsurahara | F02D 41/20 |
| 2016/0252035 | A1* | 9/2016 | Katsurahara | F02D 41/20 123/478 |
| 2016/0312735 | A1* | 10/2016 | Nakano | F02D 41/3836 |
| 2017/0002765 | A1* | 1/2017 | Nakano | F02D 41/2467 |
| 2017/0191437 | A1* | 7/2017 | Yanoto | F02D 41/20 |
| 2018/0258877 | A1 | 9/2018 | Satake | |

* cited by examiner

FUEL INJECTION CONTROL DEVICE FOR INTERNAL COMBUSTION ENGINE

CROSS REFERENCE TO RELATED APPLICATION

The present application is a continuation application of International Patent Application No. PCT/JP2018/020593 filed on May 29, 2018, which designated the U.S. and claims the benefit of priority from Japanese Patent Application No. 2017-107027 filed on May 30, 2017. The entire disclosures of all of the above applications are incorporated herein by reference.

TECHNICAL FIELD

The present disclosure relates to a fuel injection control device for an internal combustion engine.

BACKGROUND

For example, an internal combustion engine may cause a fuel injection valve to implement a multi-stage injection including a minute injection. The minute injection is likely to be implemented as a partial-lift injection that inhibits a valve element of the fuel injection valve from reaching a full-lift position.

SUMMARY

According to one aspect of the present disclosure, a fuel injection control device is for an internal combustion engine including a fuel injection valve. The fuel injection control device is configured to cause a valve element to open to inject fuel in conjunction with energization of the fuel injection valve. The fuel injection control device comprises: an injection control unit configured to implement partial-lift injection to open the fuel injection valve by an energization time such that the valve element does not reach a full-lift position.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

Figure 1:
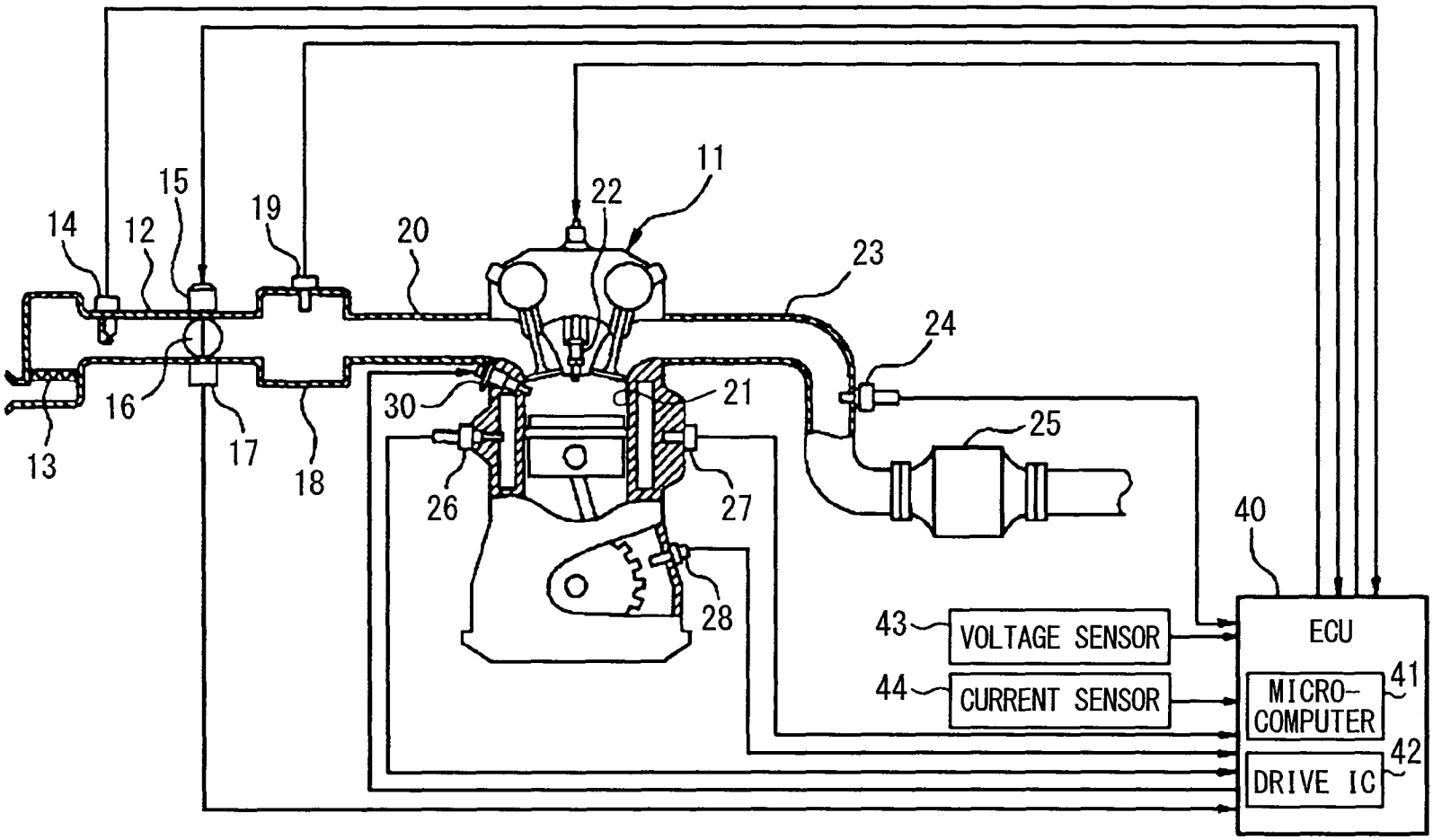
FIG. 1 is a diagram illustrating a schematic configuration of an engine control system.

To begin with, an example of the present disclosure will be described as follows. According to the example, an internal combustion engine causes a fuel injection valve to implement a multi-stage injection to perform a minute injection. In more detail, the fuel injection valve may implement, as the minute injection, a partial-lift injection that inhibits a valve element of the fuel injection valve from reaching a full-lift position.

In some example, a controller is employed to implement a full-lift control on the fuel injection valve and to detect an injection-valve opening timing or an injection-valve closing timing of the fuel injection valve when the fuel injection valve is energized for a time duration longer than or equal to a predetermined value. The controller may control the energization of the fuel injection valve based on the injection-valve opening timing or the injection-valve closing timing detected during the full-lift control of the fuel injection valve when energizing the fuel injection valve for a time duration shorter than the predetermined value and half-lift control is applied to the fuel injection valve.

The inventors found that the partial-lift injection and the full-lift injection of the fuel injection valve could differ from each other in an injection quantity characteristic during the fuel injection due to differences in lifting behaviors of the valve element. In consideration of that, a configuration is assumable to detect the injection-valve opening timing or the injection-valve closing timing for the fuel injection valve during the full-lift injection. The assumable configuration could control the energization of the fuel injection valve during the partial-lift injection (half-lift injection) by using the injection-valve opening timing or the injection-valve closing timing for the fuel injection valve detected during the full-lift injection. In this way, the assumable configuration could appropriately control the injection quantity.

It is noted that, the full-lift injection causes the valve element to reach the full-lift position (full-open position). To the contrary, the partial-lift injection does not cause the valve element to reach the full-lift position. It is further noted that, characteristics variations result from different factors. The injections are supposed to cause the difference in the injection quantity characteristics.

In more detail, after the energization starts, the full-lift injection allows the valve element to move to an injection-valve opening side and to reach the full-lift position (full-open position). In this case, a linking force (adhesive force) occurs on a contact surface of the valve element. After the energization ends, the valve element moves to an injection-valve closing side under the influence of the linking force. For example, it is likely that a large linking force causes the injection quantity to increase and a small linking force causes the injection quantity to decrease. However, the partial-lift injection is not affected by the linking force because the valve element does not reach the full-lift position after the energization starts. In this case, a contradictory phenomenon could arise. Namely, the full-lift injection causes the injection quantity to increase with respect to a nominal characteristic and the partial-lift injection causes the injection quantity to decrease with respect to the nominal characteristic. Consequently, the accuracy of controlling the fuel injection quantity could be likely to degrade.

According to one example of the present disclosure, a fuel injection control device is for an internal combustion engine including a fuel injection valve. The fuel injection control device is configured to cause a valve element to open to inject fuel in conjunction with energization of the fuel injection valve. The fuel injection control device includes an injection control unit configured to implement partial-lift injection to open the fuel injection valve by an energization time such that the valve element does not reach a full-lift position. The fuel injection control device further includes a characteristic acquisition unit configured to acquire an actual lifting behavior of the valve element as an actual lift characteristic when the partial-lift injection is implemented. The fuel injection control device further includes a fuel injection correction unit configured to compare the actual lift characteristic acquired by the characteristic acquisition unit with a predetermined reference characteristic and to correct a fuel injection quantity in the partial-lift injection based on a result of the comparison.

When the full-lift injection or the partial-lift injection is implemented, the fuel injection valve allows or does not allow the valve element to reach the full-lift position. Consequently, the full-lift injection and the partial-lift injection differ in the injection quantity characteristic. Namely, the injections differ in factors to cause the difference in the injection quantity characteristic. Focusing on this point, the above-mentioned configuration acquires the actual lifting behavior of the valve element as the actual lift characteristic when the partial-lift injection is implemented. The actual lift characteristic is compared to the predetermined reference characteristic. Based on the comparison result, the fuel injection quantity is corrected during the partial-lift injection. The injection quantity is corrected during the partial-lift injection based on the actual lift characteristic acquired during operation of the partial-lift injection. The configuration enables to appropriately correct the partial-lift injection while avoiding degradation in the accuracy due to the difference between the full-lift injection and the partial-lift injection in the injection quantity characteristic. As a result, the fuel injection valve is enabled to highly accurately implement the partial-lift injection.

Embodiments will be described with reference to the accompanying drawings. The embodiments provide a control system that controls a vehicular gasoline engine. Hereinafter, the mutually corresponding or comparable parts in the embodiments are designated by the same reference numerals. The description of the parts designated by the same reference numerals is mutually applicable.

First Embodiment

The description below explains a schematic configuration of an engine control system based on FIG. 1. An air cleaner 13 is provided at the uppermost stream of an intake pipe 12 of an engine 11 as a direct-injection multi-cylinder engine. Downstream of the air cleaner 13, an air flow meter 14 to detect the intake air quantity is provided. Downstream of the air flow meter 14, a throttle valve 16 and a throttle angle sensor 17 are provided. A motor 15 adjusts an angle of the throttle valve 16. The throttle angle sensor 17 detects an angle (throttle angle) of the throttle valve 16.

A surge tank 18 is provided downstream of the throttle valve 16. The surge tank 18 is provided with an intake pipe pressure sensor 19 to detect an intake pipe pressure. The surge tank 18 connects with an intake manifold 20 that introduces the air to each cylinder 21 of the engine 11. Each cylinder 21 of the engine is provided with an electromagnetically driven fuel injection valve 30 that directly injects the fuel into each cylinder. An ignition plug 22 is attached to a cylinder head of the engine 11 for each cylinder 21. The ignition plug 22 for each cylinder 21 causes a spark discharge to ignite an air-fuel mixture in the cylinder.

An exhaust pipe 23 of the engine 11 is provided with an exhaust air sensor 24 such as an air ratio sensor and an oxygen sensor to detect an air-fuel ratio or a rich/lean condition of the air-fuel mixture based on the exhaust air. A catalyst 25 such as a three-way catalyst to purify the exhaust air is provided downstream of the exhaust air sensor 24.

A cylinder block of the engine 11 is provided with a cooling water temperature sensor 26 to detect the cooling water temperature and a knock sensor 27 to detect knocking. A crankshaft is provided with, at the outer periphery, a crank angle sensor 28 that outputs a pulse signal each time the crankshaft rotates at a specified crank angle. A crank angle or an engine speed is detected based on a crank angle signal from the crank angle sensor 28. Outputs from the various sensors are successively input to an ECU 40.

The ECU 40 is configured as an electronic control unit mainly comprised of a microcomputer and uses a control program stored in a built-in ROM (storage medium) to provide the engine 11 with various controls based on detection signals from the various sensors. The ECU 40 is comparable to a fuel injection control device. The ECU 40 calculates the fuel injection quantity corresponding to an engine operation state, controls the fuel injection of the fuel injection valve 30, and controls the ignition timing of the ignition plug 22.

Concerning the fuel injection control in more detail, the ECU 40 includes a microcomputer 41 for engine control to implement the fuel injection control and a drive IC 42 to drive the fuel injection valve. For example, the microcomputer 41 calculates a required injection quantity based on an engine operation state such as engine speed or an engine load. Based on the required injection quantity, the microcomputer 41 calculates an injection pulse width (energization time) and outputs the injection pulse width to the drive IC 42. The drive IC 42 uses an injection pulse generated based on the injection pulse width to open the fuel injection valve 30 and inject the fuel for the required injection quantity.

The fuel injection valve 30 includes a voltage sensor 43 and a current sensor 44. The voltage sensor 43 detects a negative-terminal voltage. The current sensor 44 detects an energization current flowing into an electromagnetic portion (coil). Detection results from the voltage sensor 43 and the current sensor 44 are successively output to the ECU 40.

Figure 2:
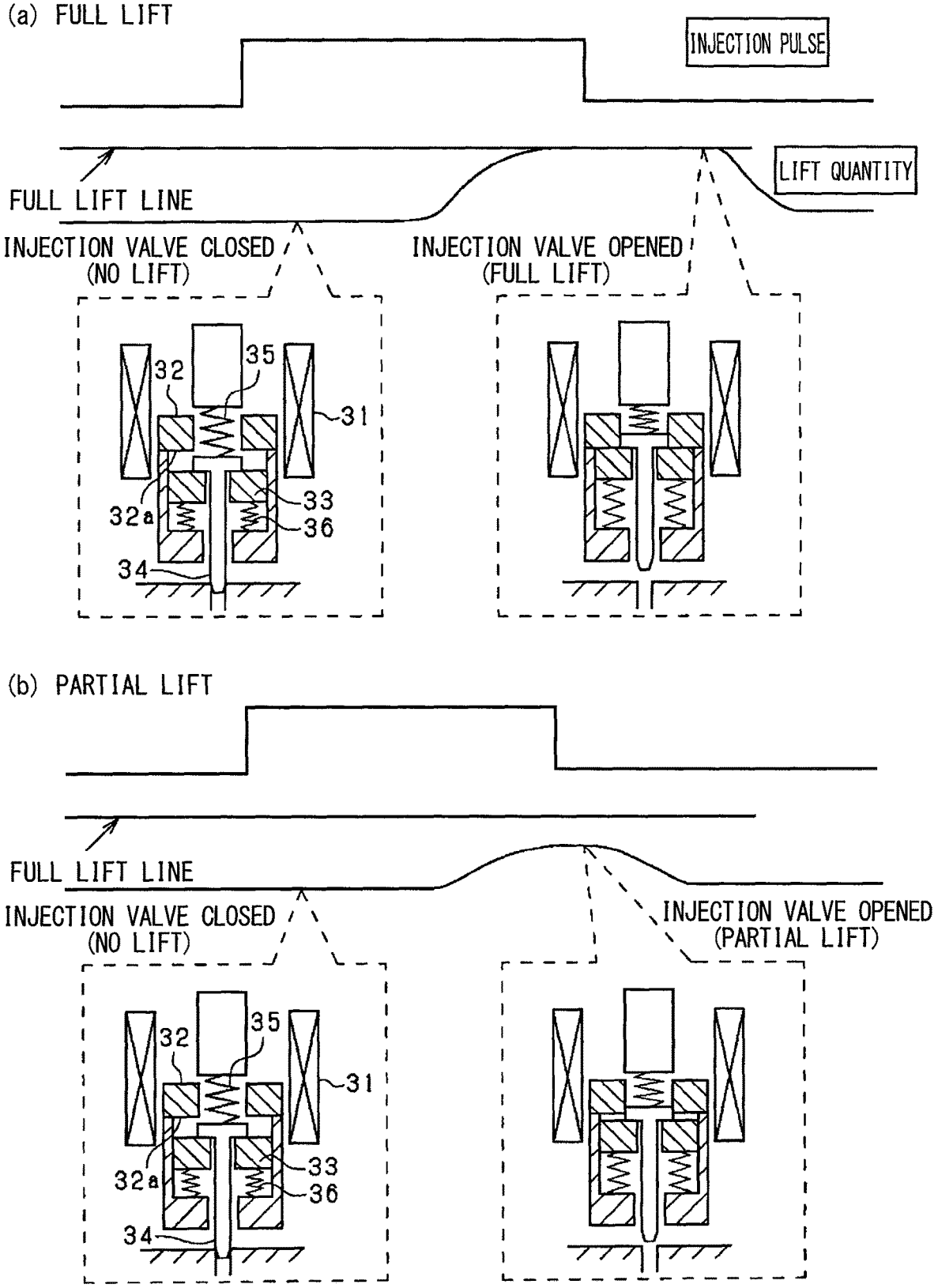
In FIG. 2, (a) is a diagram illustrating a full-lift state of a fuel injection valve and (b) is a diagram illustrating a partial-lift state of a fuel injection valve.

The present embodiment implements a partial-lift injection as one mode of driving the fuel injection valve 30. The partial-lift injection ends the movement of the valve element to the injection-valve opening side in a partial-lift state and injects the fuel for a specified quantity in the partial-lift state. The partial-lift state takes effect before the valve element of the fuel injection valve 30 reaches a full-lift position. The partial-lift injection will be described with reference to FIG. 2. In FIG. 2, (a) illustrates a full-lift injection operation and (b) illustrates a partial-lift injection operation.

As illustrated in FIG. 2, the fuel injection valve 30 includes a coil 31, a fixed core 32, a movable core 33, a valve element 34, a first spring 35, and a second spring 36. The coil 31 is provided as an electromagnetic portion that generates an electromagnetic force based on the energization. The fixed core 32 is made of a magnetic material. The movable core 33 is made of a magnetic material and is attracted toward the fixed core 32 due to the electromagnetic force. The valve element 34 is shaped into a needle and is driven integrally with the movable core 33. The first spring 35 presses the valve element 34 toward the injection-valve closing side. The second spring 36 presses the movable core 33 to a side opposite the injection-valve closing side. Due to energization of the coil 31, the valve element 34 leaves a valve seat and moves to the injection-valve opening side. The fuel injection valve 30 is thereby opened to inject the fuel. A pressing force applied to the second spring 36 is smaller than a pressing force applied to the first spring 35.

In FIG. 2, (a) and (b) differ in injection pulse widths (energization times). As illustrated in (a) in FIG. 2, the injection pulse width is relatively long and a valve element lift quantity corresponds to a full lift quantity. In this case, the valve element 34 reaches the full-lift position where the movable core 33 comes into contact with a stopper 32*a* toward the fixed core 32. As illustrated in FIG. 2 (*b*), the injection pulse width is relatively short and the valve element lift quantity corresponds to a partial lift quantity. In this case, the valve element 34 keeps the partial-lift state in which the movable core 33 is distant from the stopper 32*a* and the valve element 34 does not reach the full-lift position. The injection pulse falls to stop the energization of the coil 31, causing the movable core 33 and the valve element 34 to return to a valve closing position. The fuel injection valve 30 is thereby closed to stop the fuel injection. The movable core 33 and the valve element 34 are configured independently. When reaching the closing position, the valve element 34 stays at the closing position. However, the movable core 33 independently moves toward the end.

Figure 3:
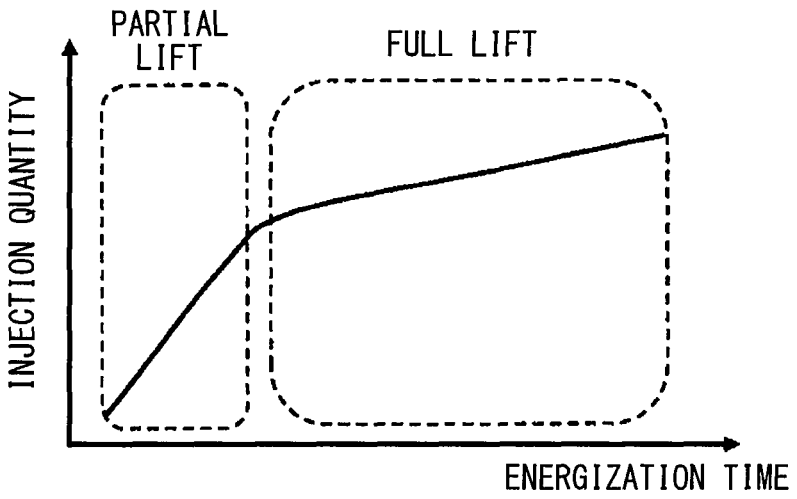
FIG. 3 is a diagram illustrating a partial-lift region and a full-lift region.

FIG. 3 is a diagram illustrating a partial-lift region to implement the partial-lift injection and a full-lift region to implement the full-lift injection. Each of the regions tends to increase the injection quantity corresponding to an increase in the energization time as an injection pulse width. The partial-lift region and the full-lift region differ in characteristics of increase or decrease in the injection quantity with reference to the energization time or differ in gradients of increase in the injection quantity with reference to the energization time, for example.

Figure 4:
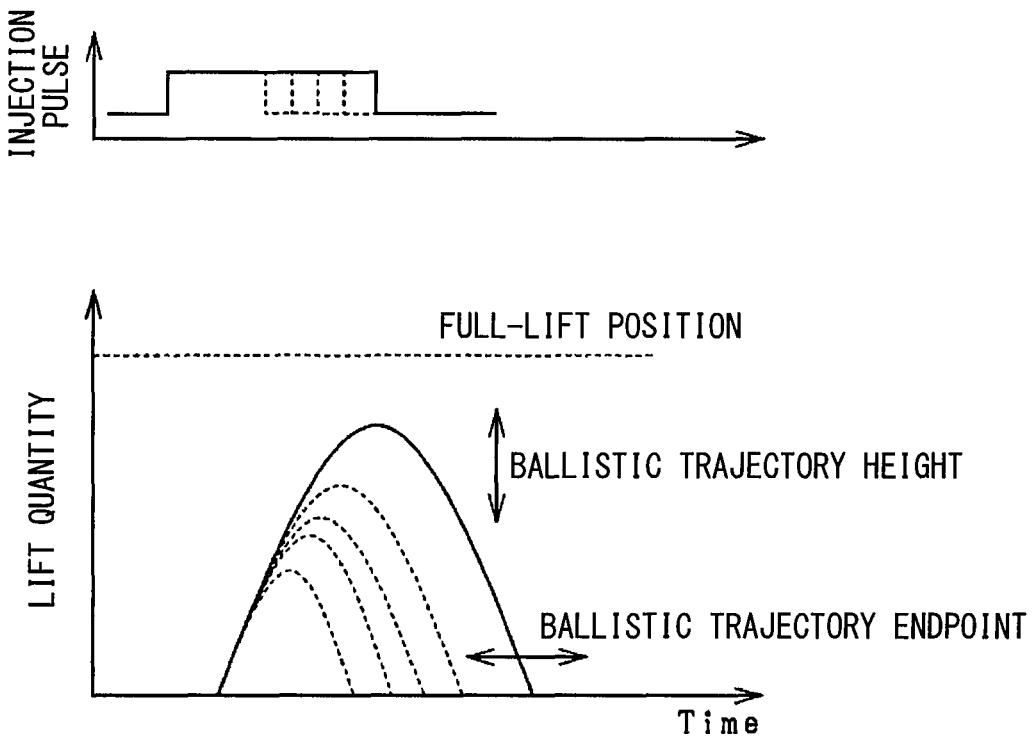
FIG. 4 is a diagram illustrating an injection pulse and a valve element lifting behavior during a partial-lift injection.

When the partial-lift injection is implemented as illustrated in FIG. 4, the valve element 34 does not reach the full-lift position (full-open position). The lifting behavior of the valve element 34 forms a parabolic ballistic trajectory. An increase in the energization time (injection pulse width) increases the height of the ballistic trajectory, namely, a peak lift position in an intermediate lift state and extends an endpoint of the ballistic trajectory or delays the timing to close the valve element 34.

Figure 5:
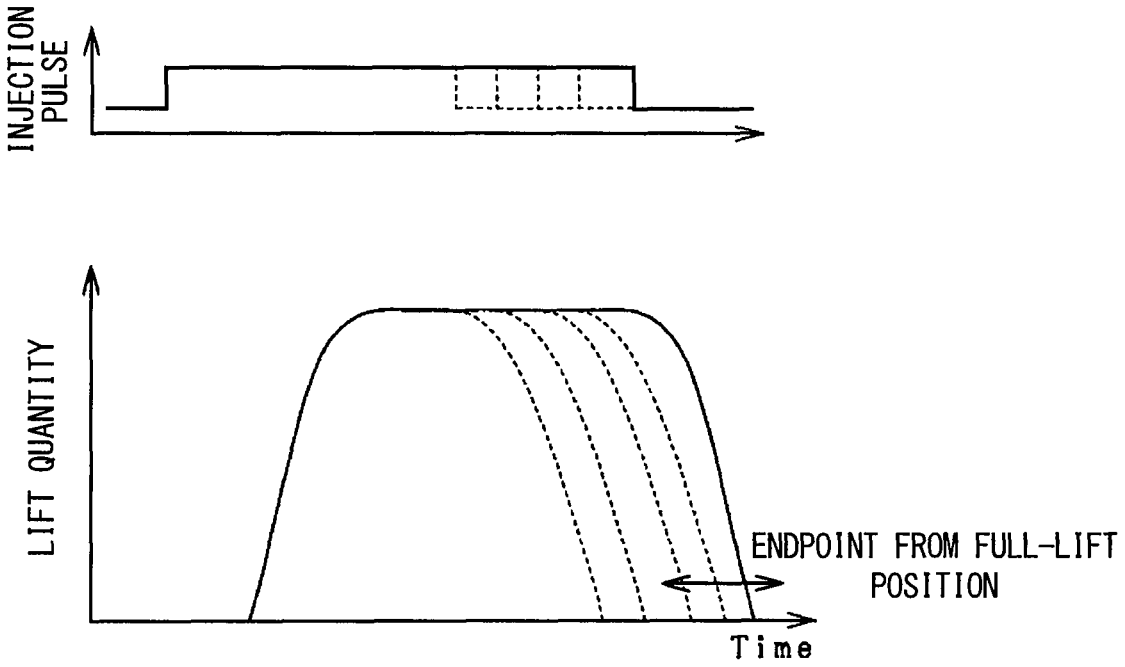
FIG. 5 is a diagram illustrating an injection pulse and a valve element lifting behavior during a full-lift injection.

When the full-lift injection is implemented as illustrated in FIG. 5, the valve element 34 reaches the full-lift position, once stays at the full-lift position, and then opens. An increase in the energization time (injection pulse width) extends an endpoint from the full-lift position or delays the timing to close the valve element 34.

The fuel injection valve 30 is likely to degrade a change characteristic of the actual injection quantity with reference to the injection pulse width in the partial-lift region and cause fuel injection quantity variations among the individuals. The partial-lift region tends to increase lifting behavior variations of the valve element 34 and increase injection quantity variations. An increase in the injection quantity variation is liable to degrade exhaust emission or drivability.

The disclosers found that the partial-lift injection and the full-lift injection implemented on the fuel injection valve 30 may cause a difference in the injection quantity characteristic during the fuel injection due to the lifting behavior differences of the valve element 34. The full-lift injection allows the valve element 34 to reach the full-lift position (full-open position). The partial-lift injection does not allow the valve element 34 to reach the full-lift position. The different factors cause variation in the characteristics. Each of the injections may cause a difference in the injection quantity characteristic. Each individual belonging to the fuel injection valve 30 may cause the difference in the injection quantity characteristic.

Figure 6:
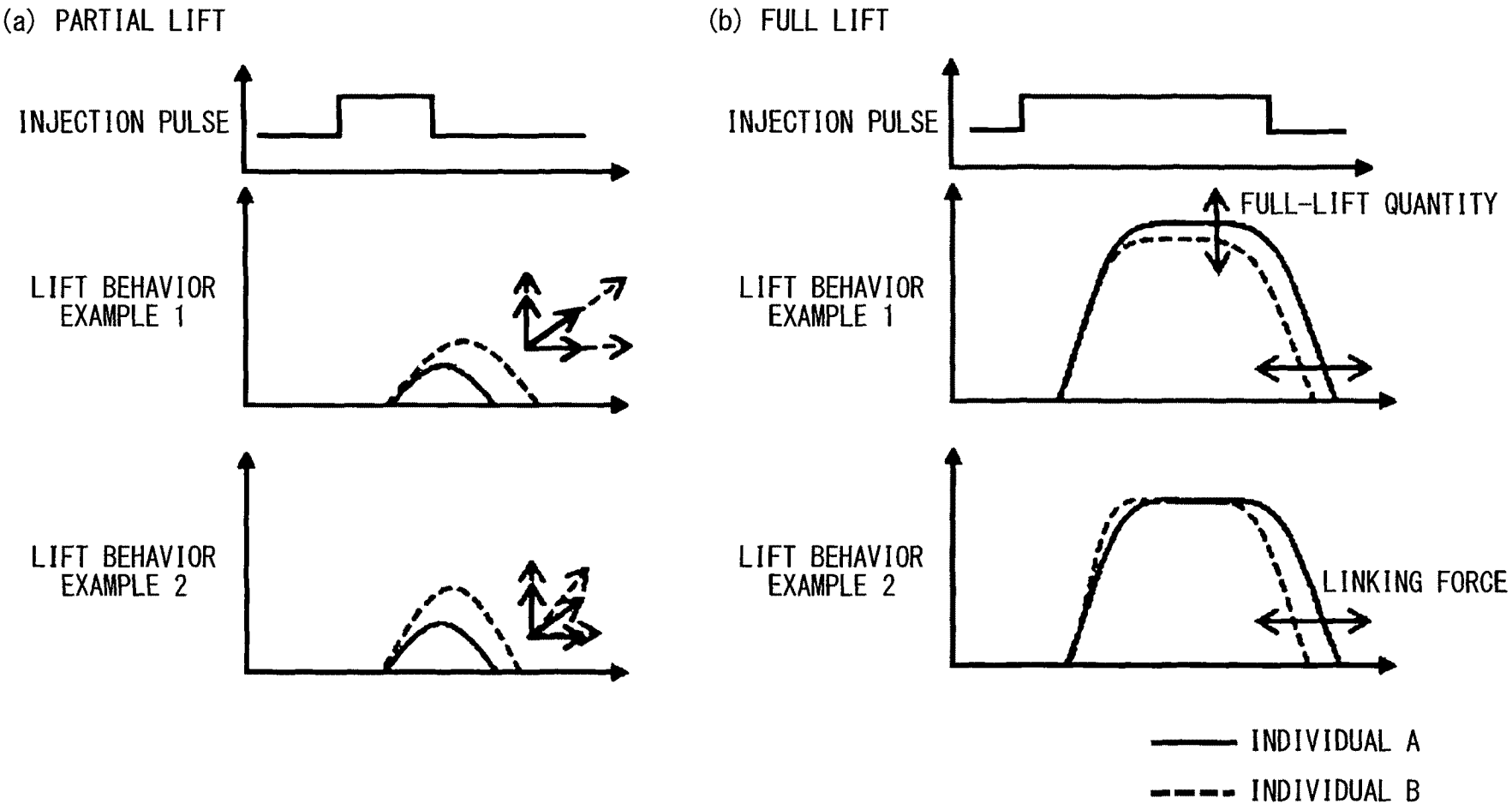
In FIG. 6, (a) is a diagram illustrating lifting behaviors of individuals A and B of the fuel injection valve during a partial-lift injection, and (b) is a diagram illustrating lifting behaviors of fuel injection valves A and B of the fuel injection valve during a full-lift injection.
Figure 7:
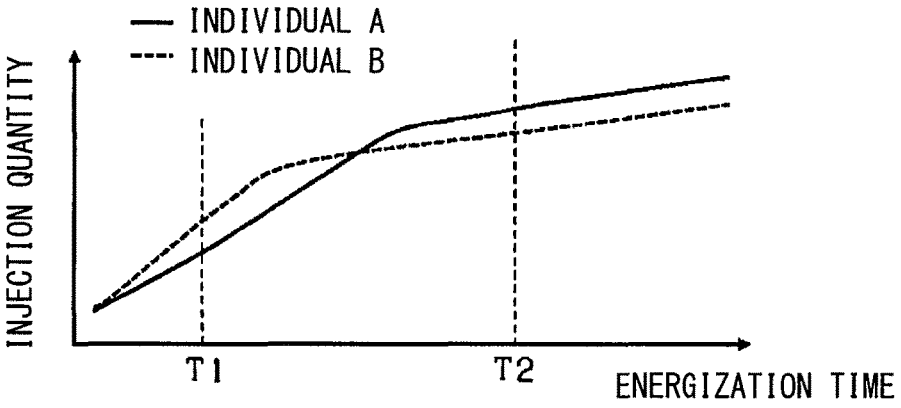
FIG. 7 is a diagram illustrating a relationship between the energization time and the injection quantity concerning individuals A and B of the fuel injection valve.

This point will be described in more detail with reference to FIGS. 6 and 7. In FIG. 6, (a) is a diagram illustrating lifting behaviors of the valve element 34 during the partial-lift injection concerning individuals A and B of the fuel injection valve 30. In FIG. 6, (b) is a diagram illustrating lifting behaviors of the valve element 34 during the full-lift injection concerning individuals A and B of the fuel injection valve 30. Individuals A and B implement lift operations as illustrated by lifting behavior examples 1 and 2 during the partial-lift injection and the full-lift injection. In FIG. 6, (a), individuals A and B use the same injection pulse and require the energization time illustrated as T1 in FIG. 7, for example. In FIG. 6, (b), individuals A and B use the same injection pulse and require the energization time illustrated as T2 in FIG. 7, for example. FIG. 7 is a diagram illustrating a relationship between the energization time and the injection quantity concerning individuals A and B as above.

When the partial-lift injection is implemented, lifting behavior examples 1 and 2 show that individuals A and B differ in the maximum lift quantity and the injection-valve closing timing at the peak lift position. Individual B increases the maximum lift quantity and delays the injection-valve closing timing. As illustrated in FIG. 7, individual A provides a smaller injection quantity than individual B regarding the injection quantity characteristic in the partial-lift region. As shown in lifting behavior examples 1 and 2, a lifting behavior difference in individuals A and B results in a variation in the lift quantity and the injection-valve closing timing. A possible cause is a variation in the spring force of the springs 35 or 36 or the electromagnetic attracting force during the coil energization.

Comparing individual A with individual B when the full-lift injection is implemented, lifting behavior example 1 shows that individual A increases the full-lift position (full-open position) and delays the injection-valve closing timing. Lifting behavior example 2 shows that individuals A and B maintain the same full-lift position but individual A delays the injection-valve closing timing. As illustrated in FIG. 7, individual A provides a larger injection quantity than individual B regarding the injection quantity characteristic in the full-lift region.

The above-mentioned individuals A and B demonstrate different injection quantity characteristics in the partial-lift region and the full-lift region. Individual A provides a smaller injection quantity than individual B in the partial-lift region. Individual A provides a larger injection quantity than individual B in the full-lift region.

When the full-lift injection is implemented, the variation of the full-lift position (lifting behavior example 1) may result from a positional variation of the fixed core 32 in the fuel injection valve 30. The variation of the injection-valve closing timing (lifting behavior example 2) may result from a variation of the linking force acting on the valve element 34 in the full-lift state. The full-lift state causes the linking force (adhesive force) on the contact surface of the valve element 34. After the injection pulse goes off, the valve element 34 moves toward the injection-valve closing side under the influence of the linking force. The injection-valve closing timing may delay as the linking force increases, for example. The linking force may vary with a fuel condition (such as viscosity).

As above, the present embodiment corrects the injection quantity in the partial-lift injection based on the recognition that the partial-lift injection and the full-lift injection implemented on the fuel injection valve 30 cause different injection quantity characteristics. When the partial-lift injection is implemented, the ECU 40 acquires an actual lifting behavior of the valve element 34 as an actual lift characteristic and compares the actual lift characteristic with a nominal characteristic as a predetermined reference characteristic. Based on a comparison result, the ECU 40 corrects the fuel injection quantity during the partial-lift injection.

The present embodiment acquires a lift parameter corresponding to the lifting behavior of the valve element 34 as an actual lift characteristic of the fuel injection valve 30 in association with the injection pulse width (energization time). Specifically, after the injection pulse goes off (the energization turns off), the injection-valve closing timing of the valve element 34 is detected as a lift parameter. The lift parameter is used to recognize the actual lift characteristic.

A technique of detecting the injection-valve closing timing for the valve element 34 is already known and therefore will be described concisely below. After the injection pulse goes off, an induced electromotive force changes the negative-terminal voltage in the fuel injection valve 30. Particularly, the negative-terminal voltage changes due to a change in the speed of the valve element 34 when reaching the valve closing position. A voltage change point occurs at the injection-valve closing timing. The voltage sensor 43 observes a change in the negative-terminal voltage, making it possible to detect the injection-valve closing timing for the fuel injection valve 30.

The negative-terminal voltage may be replaced by a coil energization current. The injection-valve closing timing may be detected based on the behavior of the energization current. The induced electromotive force may change the negative-terminal voltage after the injection pulse goes off. In this case, a change in the negative-terminal voltage changes the coil energization current. Therefore, it is possible to detect the injection-valve closing timing for the fuel injection valve 30 by using the current sensor 44 to observe a change in the coil energization current.

The partial-lift injection decreases the valve element lift quantity as the time to energize the coil 31 shortens. Therefore, the negative-terminal voltage hardly changes at the injection-valve closing timing. The present embodiment detects the injection-valve closing timing as a lift parameter when the partial-lift injection is implemented on condition of a specified high flow rate region in the partial-lift region. This will be described with reference to FIG. 8.

Figure 8:
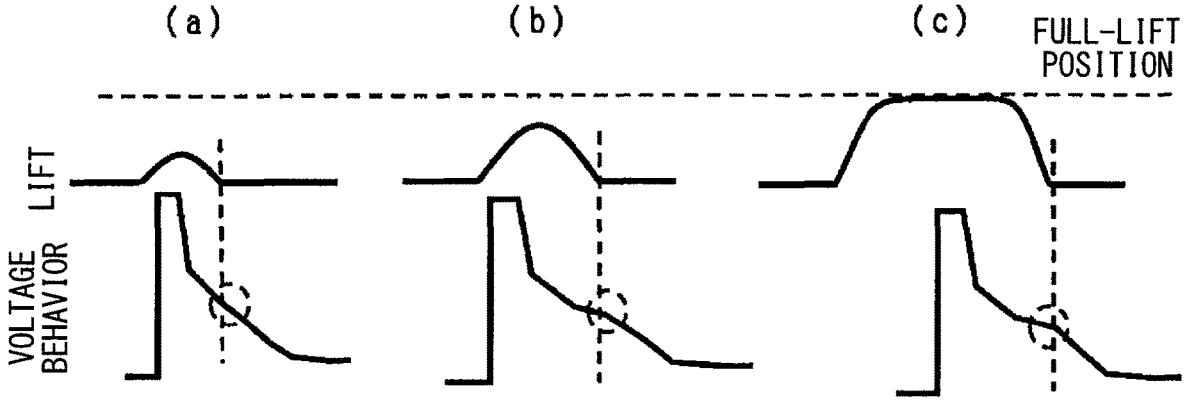
FIG. 8 is a diagram illustrating a relationship between a valve element lifting behavior and a voltage behavior with reference to the energization time.

FIG. 8 is a diagram illustrating a relationship between the lifting behavior of the valve element 34 and the behavior of the negative-terminal voltage with reference to the energization time. (a) and (b) relate to the behavior during the partial-lift injection and (c) relates to the behavior during the full-lift injection. FIG. 8 shows the energization time as (a)<(b)(c). (b) and (c) stably detect a voltage change at the injection-valve closing timing for the valve element 34. However, (a) hardly detects a voltage change at the injection-valve closing timing because the valve element lift quantity is too small. Therefore, the present embodiment detects the injection-valve closing timing as a lift parameter on condition of the specified high flow rate region in the partial-lift region.

Figure 9:
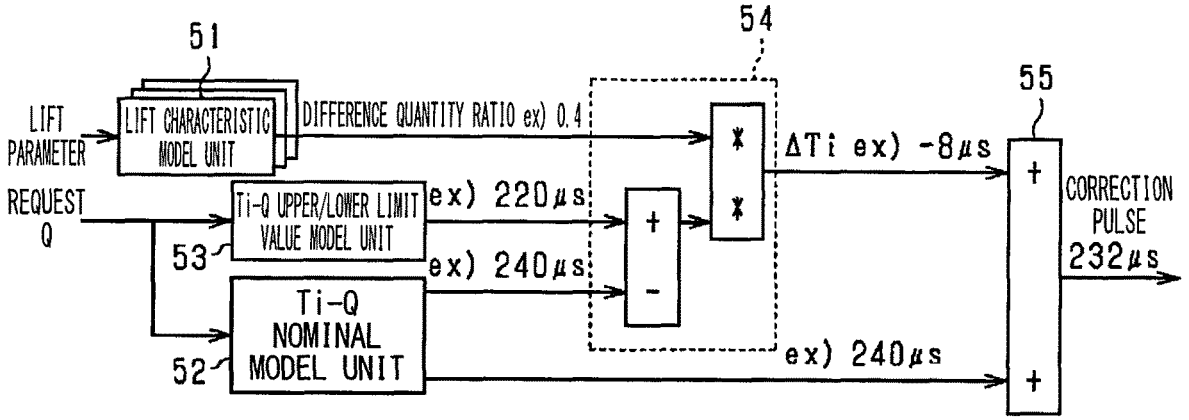
FIG. 9 is a function block diagram illustrating an injection quantity correction process during a partial-lift injection.
Figure 10:
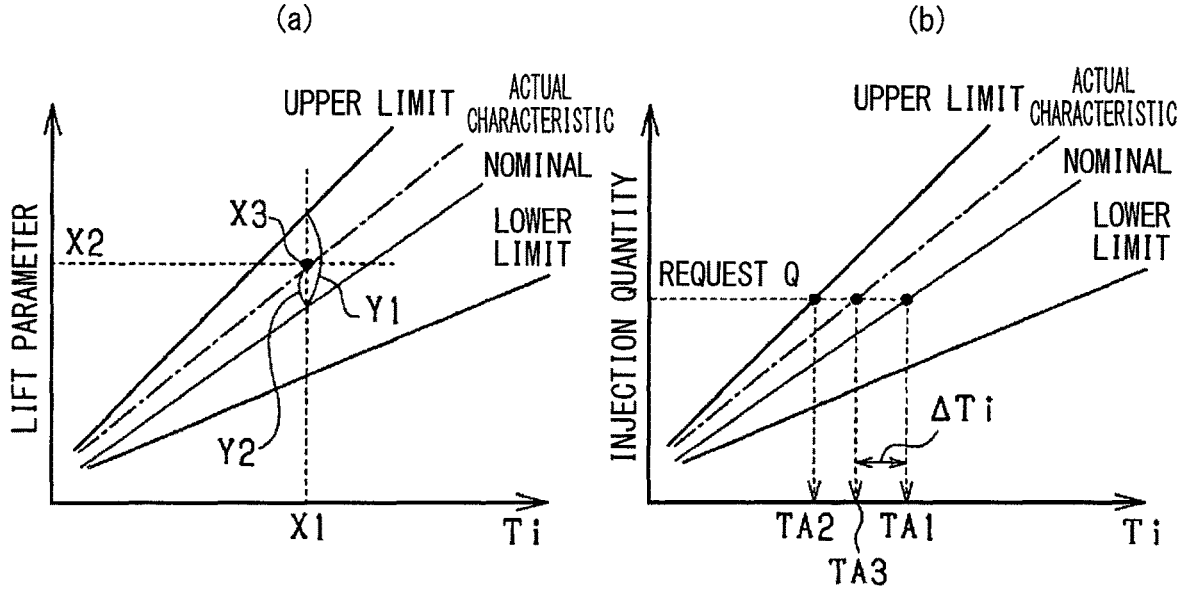
In FIG. 10, (a) is a diagram illustrating lift correlation data, and (b) is a diagram illustrating injection quantity correlation data.

FIG. 9 is a function block diagram illustrating an injection quantity correction process during the partial-lift injection. The ECU 40 embodies functions of the process. The configuration illustrated in FIG. 9 is comparable to a "fuel injection correction unit." The process uses relationships illustrated in (a) and (b) in FIG. 10 to correct the injection quantity during the partial-lift injection. In FIG. 10, (a) is a diagram illustrating lift correlation data that specifies a relationship between injection pulse width Ti and the lift parameter in the partial-lift region. In FIG. 10, (b) is a diagram illustrating injection quantity correlation data that specifies a relationship between injection pulse width Ti and fuel injection quantity Q in the partial-lift region. The memory of the ECU 40 may preferably store the correlation data in (a) and (b) in FIG. 10 as map data, for example. In FIG. 10, (a) and (b) specify a nominal characteristic as a reference characteristic, an upper limit characteristic to increase the lift parameter, and a lower limit characteristic to decrease the lift parameter. The upper limit characteristic and the lower limit characteristic are comparable to a permissible upper limit and a permissible lower limit as limitation characteristics. The nominal characteristic, the upper limit characteristic, and the lower limit characteristic provide model values defined in view of the conformity, for example, and may be defined inclusive of individual differences and environmental variations such as the temperature. The nominal characteristic, the upper limit characteristic, and the lower limit characteristic may be preferably defined as being different in lift parameter gains (gradients) with reference to injection pulse width Ti.

In FIG. 9, the lift characteristic model unit 51 uses the relationship in (a) in FIG. 10 to calculate a characteristic difference from the nominal characteristic based on injection pulse width Ti (energization time) and the lift parameter for the current partial-lift injection. The present embodiment calculates a difference quantity ratio as a characteristic difference at the upper limit side with reference to the nominal characteristic based on an actual characteristic position between the nominal characteristic and the upper limit characteristic. Alternatively, the present embodiment calculates a difference quantity ratio as a characteristic difference at the lower limit side with reference to the nominal characteristic based on an actual characteristic position between the nominal characteristic and the lower limit characteristic. The lift characteristic model unit 51 favorably includes a plurality of lift correlation data in (a) in FIG. 10 corresponding to fuel pressures.

More specifically, the calculation of the difference quantity ratio finds an actual characteristic point as X3 on condition that X1 denotes injection pulse width Ti for the current partial-lift injection and X2 denotes the lift parameter in (a) in FIG. 10. In this case, the actual lift characteristic shifts to the upper limit side with reference to the nominal characteristic. At injection pulse width X1 there is difference Y1 between the lift parameter for the upper limit characteristic and the lift parameter for the nominal characteristic. There is difference Y2 between the actual lift parameter and the lift parameter for the nominal characteristic. The ratio (Y2/Y1) is used to calculate the difference quantity ratio. For example, the difference quantity ratio is assumed to be 0.4. When the actual lift characteristic shifts to the lower limit side with reference to the nominal characteristic, the lower limit characteristic is used to calculate the difference quantity ratio.

The difference quantity ratio as a characteristic difference is favorably normalized in the partial-lift region. In this case, the difference quantity ratio is favorably calculated based on the lift parameter corresponding to a single point or a plurality of points.

The lift correlation data may define only one of the upper limit characteristic and the lower limit characteristic. It may be favorable to implement only one of a process to calculate the difference quantity ratio at the upper limit side based on the upper limit characteristic and a process to calculate the difference quantity ratio at the lower limit side based on the lower limit characteristic.

A Ti-Q nominal model unit 52 uses the nominal characteristic in the injection quantity correlation data in (b) in FIG. 10 to calculate nominal pulse width TA1 (comparable to pre-correction pulse width) as injection pulse width Ti based on the required injection quantity in each case. For example, TA1 is calculated as 240 μs. The Ti-Q upper/lower limit value model unit 53 uses the upper limit characteristic or the lower limit characteristic in the injection quantity correlation data in (b) in FIG. 10 to calculate limitation pulse width TA2 corresponding to the upper limit characteristic or the lower limit characteristic based on the required injection quantity in each case. For example, the upper limit characteristic is used to calculate TA2 as 220 μs.

A correction margin calculation unit 54 calculates pulse correction margin ΔTi by multiplying the difference quantity ratio and a difference between nominal pulse width TA1 and limitation pulse width TA2 (TA2−TA1) together. Pulse correction margin ΔTi is comparable to an energization time difference margin with reference to the nominal characteristic and is calculated as −8 μs, for example.

A correction unit 55 calculates injection pulse width TA3 after the correction based on nominal pulse width TA1 and pulse correction margin ΔTi. For example, TA3 calculated as 232 μs. The injection quantity of the partial-lift injection is controlled based on injection pulse width TA3.

According to the present embodiment, the lift characteristic model unit 51 is comparable to a "difference calculation unit." The Ti-Q nominal model unit 52, the Ti-Q upper/lower limit value model unit 53, the correction margin calculation unit 54, and the correction unit 55 are comparable to a "correction implementation unit."

The above-mentioned pulse correction technique uses the nominal characteristic and the upper/lower limit characteristic and is provided as an example. For example, an intermediate variable can be changed as needed if the nominal characteristic and the upper/lower limit characteristic are used to correct the injection pulse width.

Figure 11:
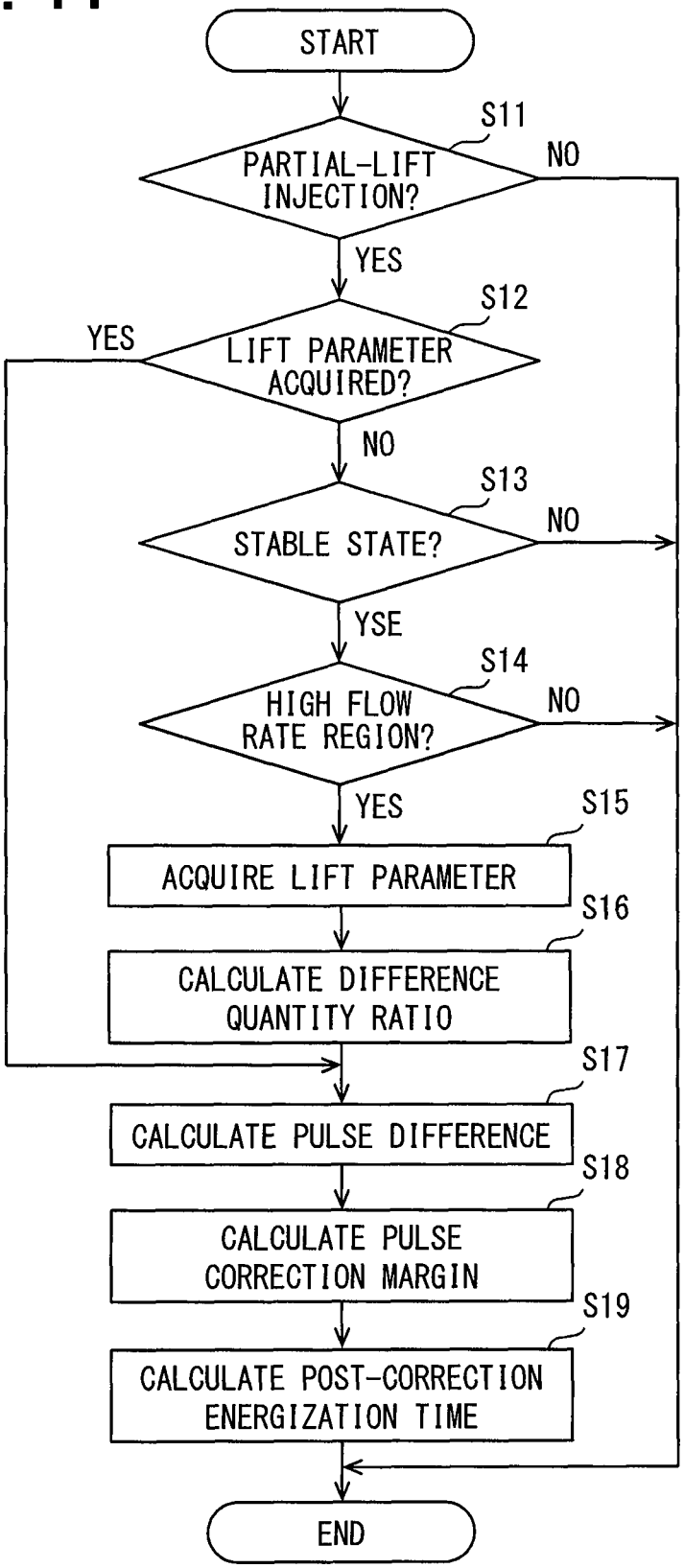
FIG. 11 is a flowchart illustrating a procedure of fuel injection control.

FIG. 11 is a flowchart illustrating a procedure of fuel injection control. The ECU 40 periodically implements this process, for example.

In step S11 of FIG. 11, the process determines whether the current fuel injection is implemented as the partial-lift injection. The process proceeds to step S12 on condition that the partial-lift injection is implemented. In step S12, the process determines whether a lift parameter is acquired. The process proceeds to step S13 if no lift parameter is acquired. The process proceeds to step S17 if the lift parameter is acquired. In step S12, the process may determine whether a difference quantity ratio is calculated.

In step S13, the process determines whether the engine 11 maintains a specified stable state. The process determines whether the engine 11 maintains the stable state based on the engine speed or the fuel pressure indicating a stable state (not a transient state) or the engine temperature satisfying a specified range.

In step S14, the process determines whether the current partial-lift injection is implemented in a specified high flow rate region in the partial-lift region. Specifically, the process determines whether the injection pulse width (energization time) is larger than or equal to a specified value. The specified value is preferably set to ½, ⅔, or ¾ of the maximum energization time defined as the partial-lift region. The process proceeds to step S15 if steps S13 and S14 result in YES. The process terminates if step S13 or S14 results in NO.

In step S15, the process acquires the lift parameter for the fuel injection valve 30. The lift parameter is associated with the energization time for the current partial-lift injection and is acquired as an actual lift characteristic. It is advantageous to detect the injection-valve closing timing based on the behavior of the negative-terminal voltage after the injection pulse goes off and acquire the injection-valve closing timing as the lift parameter. The lift parameter may be acquired based on the injection-valve closing timing detected after a plurality of injections. For example, the lift parameter may be acquired as an average of a plurality of injection-valve closing timings. A plurality of lift parameters may be acquired corresponding to temperature conditions of the fuel injection valve 30 or the engine 11, for example.

In step S16, the process calculates a characteristic difference for the actual lift characteristic, namely, a difference quantity ratio at the upper limit side with reference to the nominal characteristic or a difference quantity ratio at the lower limit side with reference to the nominal characteristic and stores the difference quantity ratio in the memory.

In step S17, the process calculates a pulse difference (TA2−TA1) between nominal pulse width TA1 calculated based on the required injection quantity in each case and limitation pulse width TA2 calculated based on the required injection quantity. In step S18, the process multiplies the pulse difference by the difference quantity ratio to calculate pulse correction margin ΔTi. In step S19, the process calculates the post-correction energization time (injection pulse width TA3) based on nominal pulse width TA1 and pulse correction margin ΔTi.

When step S12 results in YES and control proceeds to step S17 from step S12, the process reads the difference quantity ratio from the memory and calculates pulse correction margin ΔTi by using the difference quantity ratio in step S18. The partial-lift injection may be implemented in a region in which a flow rate is lower than that of a specified high flow rate region. In such a case, the injection quantity correction is implemented based on the difference quantity ratio (actual lift characteristic) acquired when the partial-lift injection is implemented in the high flow rate region.

The partial-lift injection may be implemented at the side indicating a flow rate higher than the injection quantity available when the difference quantity ratio (actual lift characteristic) is acquired. Even in this case, the injection quantity correction can be implemented in the partial-lift region based on the already acquired difference quantity ratio (actual lift characteristic).

When the process in FIG. 11 acquires the lift parameter, the process may store the lift parameter in the memory (step S15) and may calculate pulse correction margin ΔTi by using the lift parameter read from the memory in step S18.

The present embodiment described above in detail provides excellent effects as follows.

When the full-lift injection or the partial-lift injection is implemented, the fuel injection valve 30 allows or does not allow the valve element 34 to reach the full-lift position. Consequently, the full-lift injection and the partial-lift injection differ in the injection quantity characteristic. Namely, the injections differ in factors to cause the difference in the injection quantity characteristic. Focusing on this point, the above-mentioned configuration acquires the actual lifting behavior of the valve element 34 as the actual lift characteristic when the partial-lift injection is implemented. The actual lift characteristic is compared to the predetermined reference characteristic (nominal characteristic). Based on the comparison result, the fuel injection quantity is corrected during the partial-lift injection. The injection quantity is corrected during operation of the partial-lift injection based on the actual lift characteristic acquired during operation of the partial-lift injection. It is possible to appropriately correct the partial-lift injection while avoiding degradation in the accuracy due to the difference between the full-lift injection and the partial-lift injection in the injection quantity characteristic. As a result, the fuel injection valve 30 can highly accurately implement the partial-lift injection.

The partial-lift injection is accompanied by the minute injection having a small injection pulse width (short energization time). In this case, the lift quantity of the valve element 34 decreases as the injection pulse width decreases. It is difficult to acquire the actual lift characteristic accordingly. To solve this, the actual lift characteristic is acquired when the partial-lift injection is implemented in a specified high flow rate region and in the partial-lift region. The actual lift characteristic is used to correct the injection quantity of the partial-lift injection. Therefore, the injection quantity can be corrected appropriately.

When the lift parameter is acquired based on the behavior of the negative-terminal voltage or the behavior of the coil energization current for the fuel injection valve 30, too small an injection pulse width disables an appropriate observation on the behavior of the negative-terminal voltage or the behavior of the coil energization current. The lift parameter may not be acquired appropriately. To solve this, the lift parameter is acquired on condition that the partial-lift injection is implemented in the high flow rate region in the partial-lift region. Therefore, the lift parameter can be acquired appropriately.

In the partial-lift region, when the partial-lift injection is implemented in a region in which a flow rate is lower than that of a specified high flow rate region, the injection quantity is corrected based on the difference quantity ratio calculated during operation of the partial-lift injection in the high flow rate region. Therefore, the injection quantity can be corrected appropriately even if it is impossible to acquire the lift parameter for the low flow rate region in the partial-lift region. Namely, it is possible to avoid the use of a lowly accurate lift parameter and appropriately correct the injection quantity by using the highly accurate lift parameter acquired in the high flow rate region.

It is possible to appropriately correct the injection quantity in a wide range of the partial-lift region and limit the range of acquiring the lift parameter. Therefore, it is possible to decrease the number of times of calculations or reduce calculation loads.

The lift correlation data defines the relationship between the injection pulse width (energization time) and the lift parameter in the partial-lift region. The partial-lift region is used to calculate the characteristic difference (difference quantity ratio) with reference to the nominal characteristic based on the energization time and the lift parameter for the current partial-lift injection. The injection quantity is corrected based on the characteristic difference. Therefore, it is possible to correct the injection quantity for the partial-lift injection in the partial-lift region with reference to the nominal characteristic.

The difference quantity ratio with reference to the nominal characteristic is calculated based on the lift parameter position between the nominal characteristic and the limitation characteristic (the upper limit characteristic or the lower limit characteristic). The low flow rate side and the high flow rate side in the partial-lift region may differ from each other in a variation margin tendency with reference to the nominal characteristic. Even in such a case, the injection quantity can be corrected appropriately by using the difference quantity ratio instead of the absolute quantity of a difference. The difference quantity ratio can be used to appropriately correct the injection quantity even in a region outside the region where the lift parameter is actually acquired.

The injection quantity correlation data defines the relationship between the injection pulse width (energization time) and the injection quantity in the partial-lift region. The injection quantity correlation data is used to calculate pulse correction margin ΔTi (energization time difference margin) in the injection quantity correlation data with reference to the nominal characteristic based on the difference quantity ratio. The injection quantity is corrected by correcting the injection pulse width Ti based on pulse correction margin ΔTi. In this case, the injection quantity can be corrected appropriately with reference to the nominal characteristic in the injection quantity correlation data.

Second Embodiment

Figure 12:
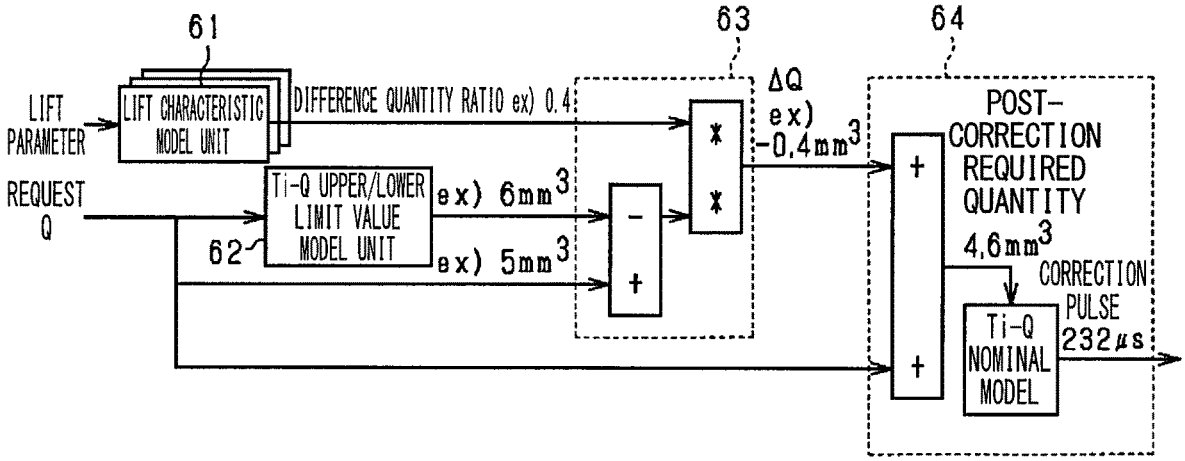
FIG. 12 is a function block diagram illustrating an injection quantity correction process during a partial-lift injection according to a second embodiment.
Figure 13:
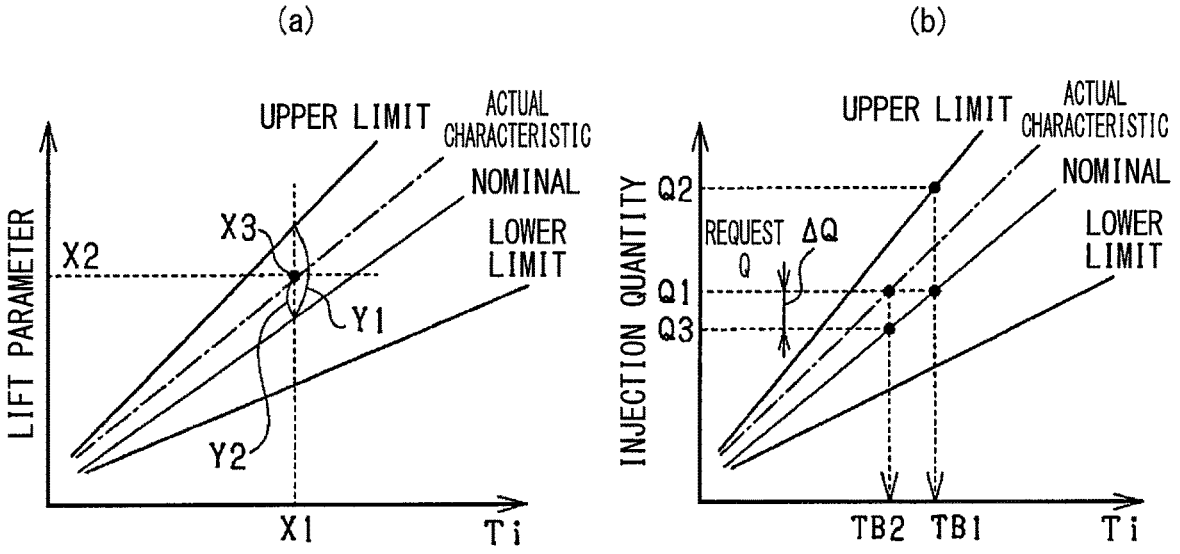
In FIG. 13, (a) is a diagram illustrating lift correlation data; and (b) is a diagram illustrating injection quantity correlation data.

According to the present embodiment, the injection quantity correlation data defines the relationship between the energization time and the injection quantity in the partial-lift region. The injection quantity correlation data is used to calculate an injection quantity difference margin in the injection quantity correlation data with reference to the nominal characteristic based on the characteristic difference of the fuel injection valve 30. The energization time is corrected based on the injection quantity difference margin, FIG. 12 is a function block diagram illustrating an injection quantity correction process during the partial-lift injection. The ECU 40 embodies functions of the process. The process uses relationships illustrated in (a) and (b) in FIG. 13 to correct the injection quantity during the partial-lift injection. In FIG. 13, (a) is a diagram illustrating lift correlation data similar to (a) in FIG. 10 above. In FIG. 13, (b) is a diagram illustrating injection quantity correlation data similar to (b) in FIG. 10 above. The nominal characteristic, the upper limit characteristic, and the lower limit characteristic are defined in (a) and (b) in FIG. 13.

In FIG. 12, a lift characteristic model unit 61 uses the relationship in (a) in FIG. 13 to calculate a characteristic difference from the nominal characteristic based on injection pulse width Ti (energization time) and the lift parameter for the current partial-lift injection. The lift characteristic model unit 61 is configured to be equal to the lift characteristic model unit 51 in FIG. 9 above. An actual characteristic point is found as X3 on condition that X1 denotes injection pulse width Ti for the current partial-lift injection and X2 denotes the lift parameter in (a) in FIG. 13. There is difference Y1 between the lift parameter for the upper limit characteristic and the lift parameter for the nominal characteristic. There is difference Y2 between the actual lift parameter and the lift parameter for the nominal characteristic. The ratio (Y2/Y1) is used to calculate the difference quantity ratio. For example, the difference quantity ratio is assumed to be 0.4.

A Ti-Q upper/lower limit value model unit 62 uses the upper limit characteristic or the lower limit characteristic illustrated in (b) in FIG. 13 to calculate a limitation injection quantity corresponding to the upper limit characteristic or the lower limit characteristic based on the injection pulse width for the nominal characteristic corresponding to the required injection quantity in each case. In (b) in FIG. 13, Q1 denotes the required injection quantity; TB1 denotes the injection pulse width for the nominal characteristic corresponding to required injection quantity Q1; and Q2 denotes an upper limit injection quantity for the upper limit characteristic corresponding to injection pulse width TB1. For example, Q1 is assumed to be 5 mm3 and Q2 is assumed to be 6 mm3.

There is a difference between required injection quantity Q1 and limitation injection quantity Q2 (the upper limit injection quantity or the lower limit injection quantity). A correction margin calculation unit 63 multiplies the difference (Q1−Q2) by the difference quantity ratio to calculate injection quantity correction margin ΔQ. The injection quantity correction margin ΔQ is comparable to an injection quantity difference margin with reference to the nominal characteristic. For example, ΔQ is assumed to be −0.4 mm3.

A correction unit 64 calculates post-correction required quantity Q3 based on required injection quantity Q1 and injection quantity correction margin ΔQ. The correction unit 64 calculates TB2, namely, an injection pulse width corresponding to post-correction required quantity Q3 for the nominal characteristic. For example, TB2 is assumed to be 232 μs. Injection pulse width TB2 is equal to the injection pulse width after the correction. The injection quantity of the partial-lift injection is controlled based on injection pulse width TB2.

According to the present embodiment, the lift characteristic model unit 61 is comparable to a "difference calculation unit." The Ti-Q upper/lower limit value model unit 62, the correction margin calculation unit 63, and the correction unit 64 are comparable to a "correction implementation unit."

Figure 14:
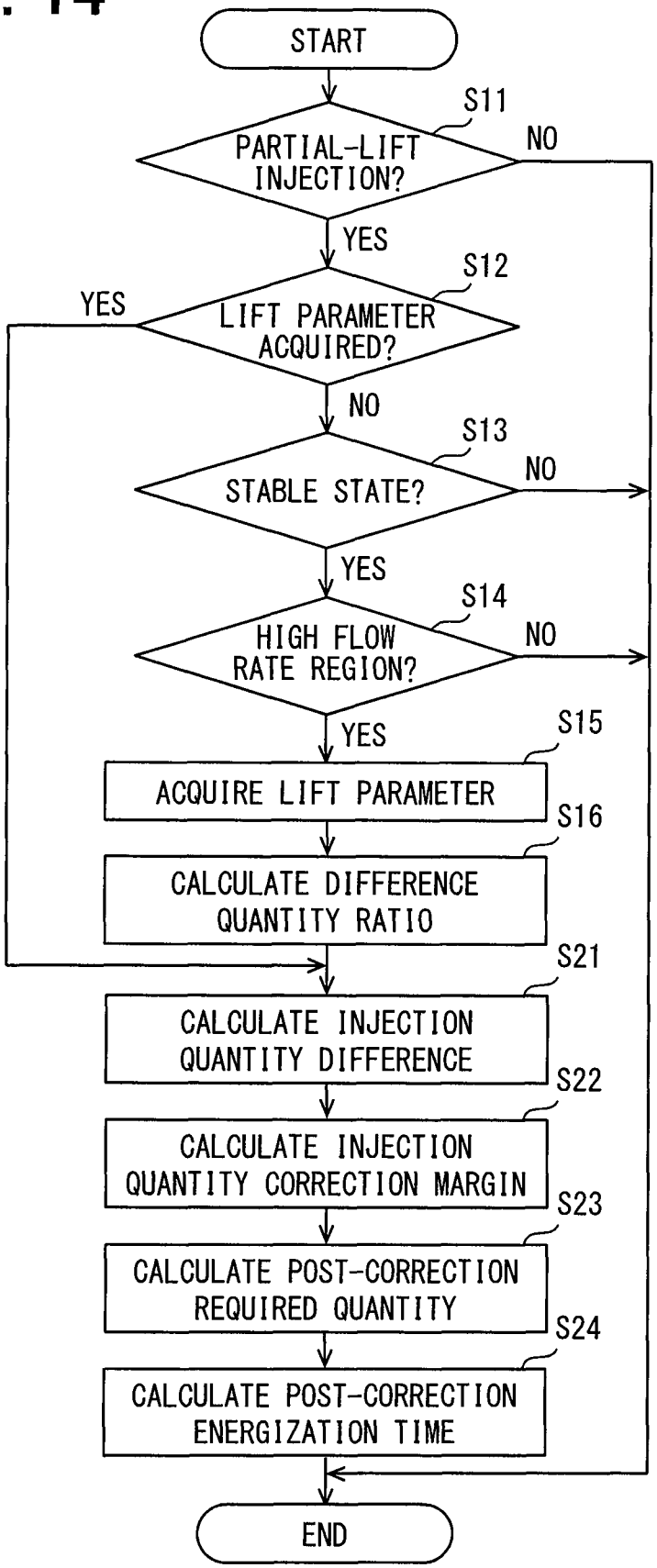
FIG. 14 is a flowchart illustrating a procedure of fuel injection control according to the second embodiment.

FIG. 14 is a flowchart illustrating a procedure of fuel injection control. The ECU 40 periodically implements this process, for example. This process replaces the above-mentioned process in FIG. 11. In FIG. 14, the same process as in FIG. 11 is given the same step number and the description is omitted for simplicity.

Steps S11 to S16 in FIG. 14 provide the same process as in FIG. 11. Steps S11 to S16 calculate a difference quantity ratio based on the lift parameter when the partial-lift injection is implemented.

In step S21, the process calculates an injection quantity difference between required injection quantity Q1 and limitation injection quantity Q2 (upper limit injection quantity or lower limit injection quantity). In step S22, the process multiplies the injection quantity difference by the difference quantity ratio to calculate injection quantity correction margin ΔQ. In step S23, the process calculates post-correction required quantity Q3 based on required injection quantity Q1 and injection quantity correction margin ΔQ. In step S24, the process calculates the post-correction energization time (injection pulse width TB2), namely, an injection pulse width corresponding to post-correction required quantity Q3 for the nominal characteristic.

As above, the present embodiment can appropriately correct the injection quantity with reference to the nominal characteristic in the injection quantity correlation data.

Third Embodiment

According to the present embodiment, the injection quantity correlation data defines the relationship between the energization time and the injection quantity in the partial-lift region. The embodiment calculates an energization time difference margin with reference to the nominal characteristic for a plurality of injection quantities based on a characteristic difference of the fuel injection valve 30 in the injection quantity correlation data. The embodiment corrects the injection quantity by updating the injection quantity correlation data based on a plurality of energization time difference margins. The injection quantity correlation data is preferably updated all over the partial-lift region. It is advantageous to define a plurality of injection quantities in a wide range (such as an entire range) of the partial-lift region.

Figure 15:
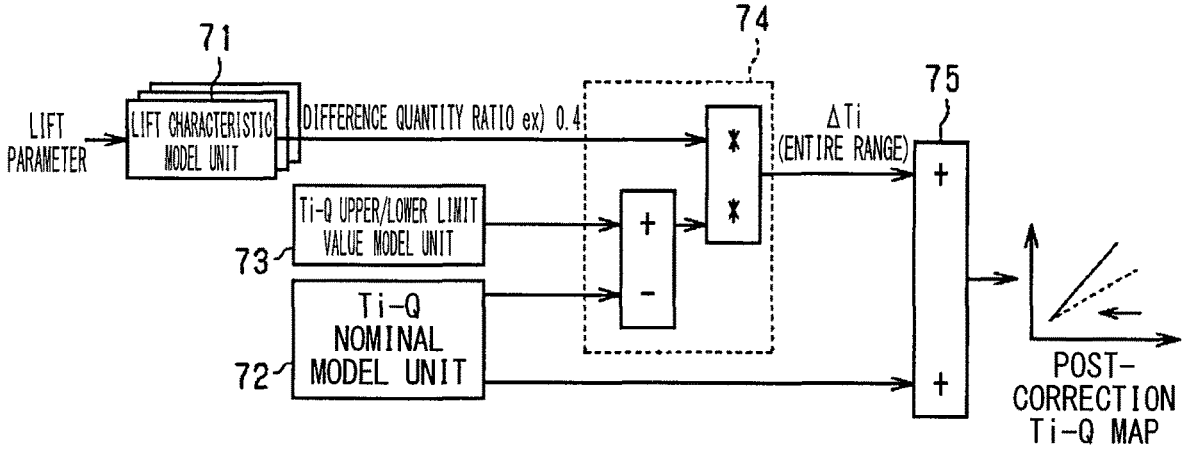
FIG. 15 is a function block diagram illustrating an injection quantity correction process during a partial-lift injection according to a third embodiment.

FIG. 15 is a function block diagram illustrating a characteristic update process during the partial-lift injection. The ECU 40 embodies functions of the process.

In FIG. 15, a lift characteristic model unit 71 uses the above-mentioned lift correlation data in (a) in FIG. 10 to calculate a characteristic difference (difference quantity ratio) from the nominal characteristic based on the actual lift parameter acquired during operation of the partial-lift injection. The lift characteristic model unit 71 is configured to be equal to the above-mentioned lift characteristic model unit 51 in FIG. 9.

A Ti-Q nominal model unit 72 stores the nominal characteristic in the injection quantity correlation data. A Ti-Q upper/lower limit value model unit 73 stores the upper limit characteristic and the lower limit characteristic in the injection quantity correlation data (see FIG. 16).

A correction margin calculation unit 74 calculates an upper-limit time difference or a lower-limit time difference, namely, a difference between the nominal characteristic and the upper limit characteristic or the lower limit characteristic with regard to a plurality of injection quantities all over the injection quantity range in the partial-lift region. The correction margin calculation unit 74 uses the time difference and the difference quantity ratio to calculate a plurality of pulse correction margins ΔTi (energization time difference margins) all over the injection quantity range in the partial-lift region.

A characteristic update unit 75 updates the nominal characteristic of the injection quantity correlation data by adding pulse correction margin ΔTi with regard to a plurality of injection quantities to injection pulse width Ti for the nominal characteristic all over the injection quantity range in the partial-lift region. In this case, the injection quantity correlation data as map data is updated (rewritten), for example.

According to the present embodiment, the lift characteristic model unit 71 is comparable to a "difference calculation unit." The Ti-Q nominal model unit 72, the Ti-Q upper/lower limit value model unit 73, the correction margin calculation unit 74, and the characteristic update unit 75 are comparable to a "correction implementation unit."

Figure 16:
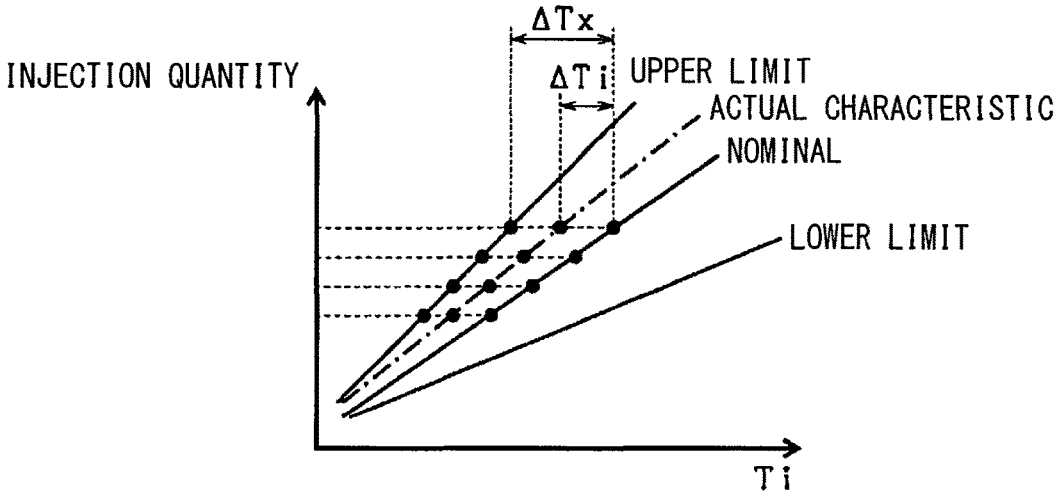
FIG. 16 is a diagram illustrating injection quantity correlation data.

The above-mentioned update process will be described more specifically with reference to FIG. 16. The following assumes a case where the actual lift characteristic shifts to the upper limit from the nominal characteristic. In FIG. 16, the process calculates upper-limit time difference ΔTx between the nominal characteristic and the upper limit characteristic with regard to a plurality of injection quantities. In addition, the process calculates pulse correction margin ΔTi. Pulse correction margin ΔTi is added to each injection quantity to update the nominal characteristic. It is possible to find a post-correction characteristic appropriate to the actual lift characteristic.

Figure 17:
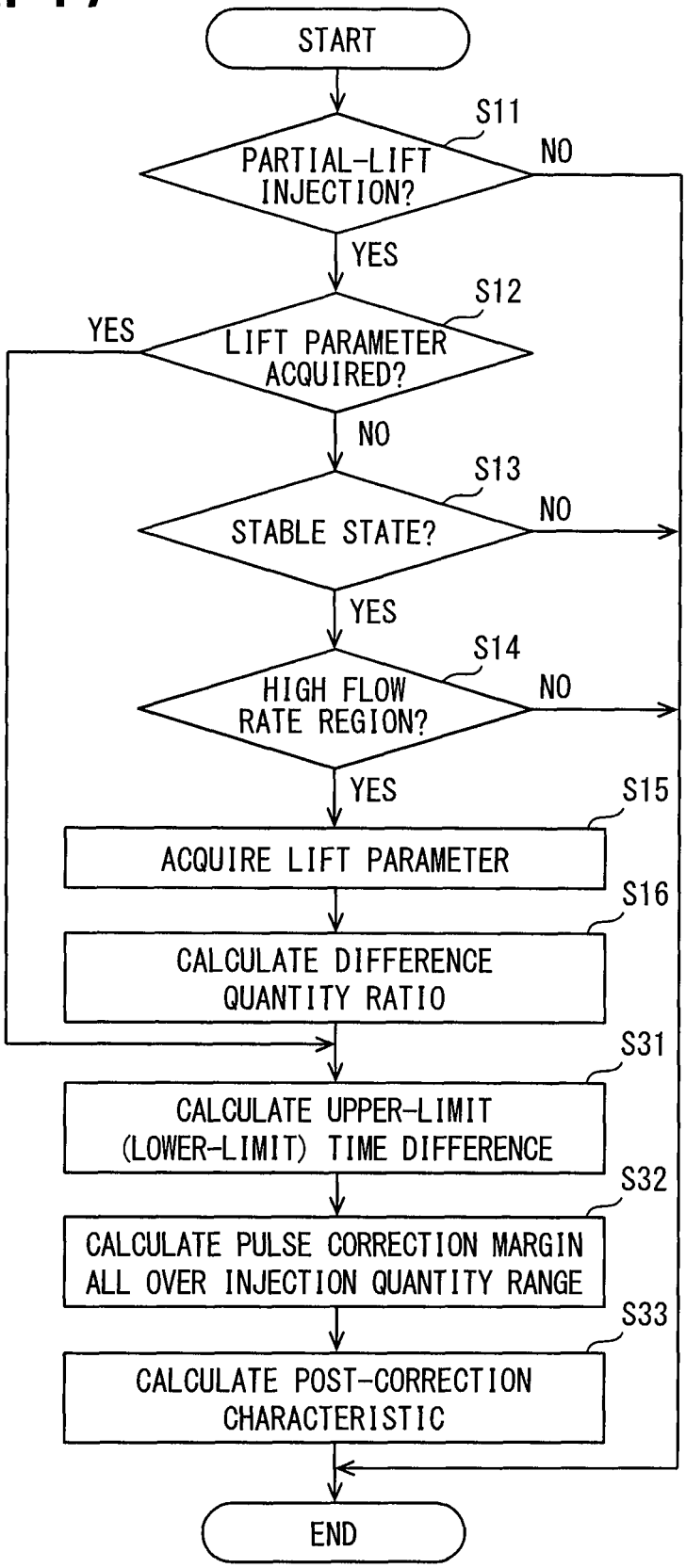
FIG. 17 is a flowchart illustrating a procedure of fuel injection control according to the third embodiment.

FIG. 17 is a flowchart illustrating a procedure of fuel injection control. The ECU 40 periodically implements this process, for example. This process replaces the above-mentioned process in FIG. 11. In FIG. 17, the same process as in FIG. 11 is given the same step number and the description is omitted for simplicity.

Steps S11 to S16 in FIG. 17 provide the same process as in FIG. 11. Steps S11 to S16 calculate a difference quantity ratio based on the lift parameter when the partial-lift injection is implemented.

In step S31, the process calculates an upper-limit time difference or a lower-limit time difference, namely, an energization time difference between the nominal characteristic and the upper limit characteristic or the lower limit characteristic with regard to a plurality of injection quantities all over the injection quantity range in the partial-lift region. In step S32, the process uses the time difference and the difference quantity ratio to calculate pulse correction margin ΔTi all over the injection quantity range in the partial-lift region. In step S33, the process uses pulse correction margin ΔTi with regard to a plurality of injection quantities all over the injection quantity range in the partial-lift region to update the nominal characteristic. Thereby, the post-correction characteristic is calculated.

As above, the present embodiment can update the injection quantity correlation data used for the partial-lift region based on the difference quantity ratio calculated during operation of the partial-lift injection. It is possible to appropriately control the fuel injection quantity based on the data update. The correction process is implemented in a wide range of injection at a time by updating (rewriting) the map data, for example. It is possible to reduce loads on the correction calculation.

Fourth Embodiment

According to the present embodiment, the injection quantity correlation data defines the relationship between the energization time and the injection quantity in the partial-lift region. The embodiment calculates an injection quantity difference margin with reference to the reference characteristic for a plurality of energization times based on a characteristic difference of the fuel injection valve 30 in the injection quantity correlation data. The embodiment corrects the injection quantity correlation data based on a plurality of injection quantity difference margins to correct the injection quantity. The injection quantity correlation data is preferably updated all over the partial-lift region. It is advantageous to define a plurality of injection quantities in a wide range (such as an entire range) of the partial-lift region.

Figure 18:
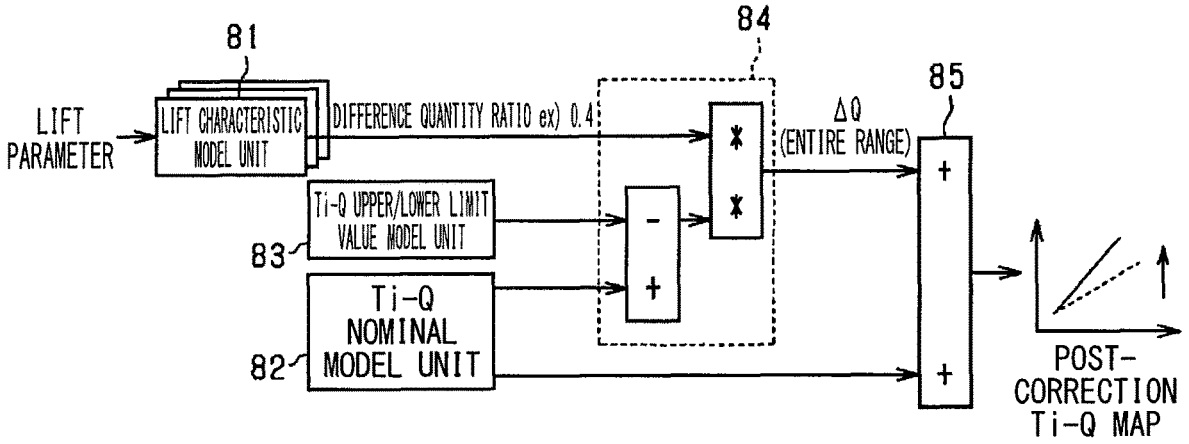
FIG. 18 is a function block diagram illustrating an injection quantity correction process during a partial-lift injection according to a fourth embodiment.

FIG. 18 is a function block diagram illustrating a characteristic update process during the partial-lift injection. The ECU 40 embodies functions of the process.

In FIG. 18, a lift characteristic model unit 81 uses the above-mentioned lift correlation data in (a) in FIG. 10 to calculate a characteristic difference (difference quantity ratio) from the nominal characteristic based on the actual lift parameter acquired during operation of the partial-lift injection. The lift characteristic model unit 81 is configured to be equal to the above-mentioned lift characteristic model unit 51 in FIG. 9.

A Ti-Q nominal model unit 82 stores the nominal characteristic in the injection quantity correlation data. A Ti-Q upper/lower limit value model unit 83 stores the upper limit characteristic and the lower limit characteristic in the injection quantity correlation data (see FIG. 19).

A correction margin calculation unit 84 calculates an upper-limit flow rate difference or a lower-limit flow rate difference, namely, a difference between the nominal characteristic and the upper limit characteristic or the lower limit characteristic with regard to a plurality of energization times all over the energization time range in the partial-lift region. The correction margin calculation unit 84 uses the flow rate difference and the difference quantity ratio to calculate a plurality of injection quantity correction margins ΔQ (injection quantity difference margins) all over the energization time range in the partial-lift region.

A characteristic update unit 85 updates the nominal characteristic of the injection quantity correlation data by adding injection quantity correction margin ΔQ with regard to a plurality of energization times (injection pulse widths) to the injection quantity for the nominal characteristic all over the injection quantity range in the partial-lift region. In this case, the injection quantity correlation data as map data is updated (rewritten), for example.

According to the present embodiment, the lift characteristic model unit 81 is comparable to a "difference calculation unit." The Ti-Q nominal model unit 82, the Ti-Q upper/lower limit value model unit 83, the correction margin calculation unit 84, and the characteristic update unit 85 are comparable to a "correction implementation unit."

Figure 19:
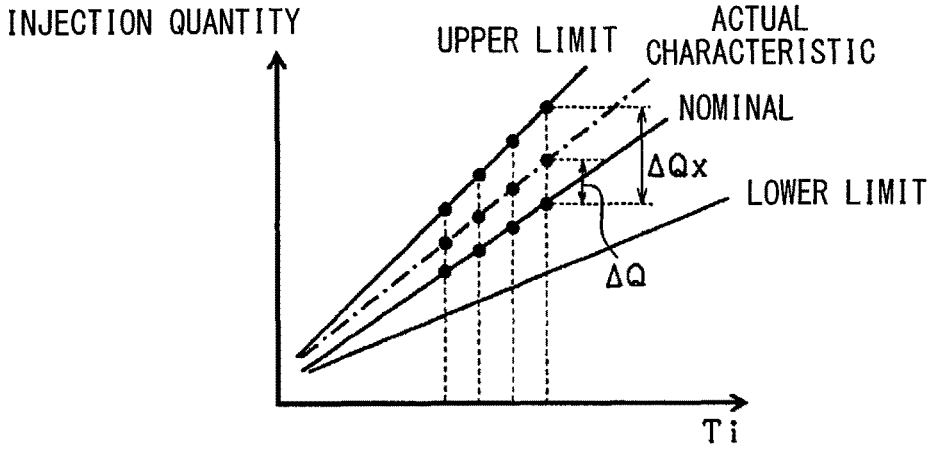
FIG. 19 is a diagram illustrating injection quantity correlation data.

The above-mentioned update process will be described more specifically with reference to FIG. 19. The following assumes a case where the actual lift characteristic shifts to the upper limit from the nominal characteristic. In FIG. 19, the process calculates upper-limit flow rate difference ΔQx between the nominal characteristic and the upper limit characteristic with regard to a plurality of energization times (injection pulse widths). In addition, the process calculates injection quantity correction margin ΔQ. Injection quantity correction margin ΔQ is added to each energization time to update the nominal characteristic. It is possible to find a post-correction characteristic appropriate to the actual lift characteristic.

Figure 20:
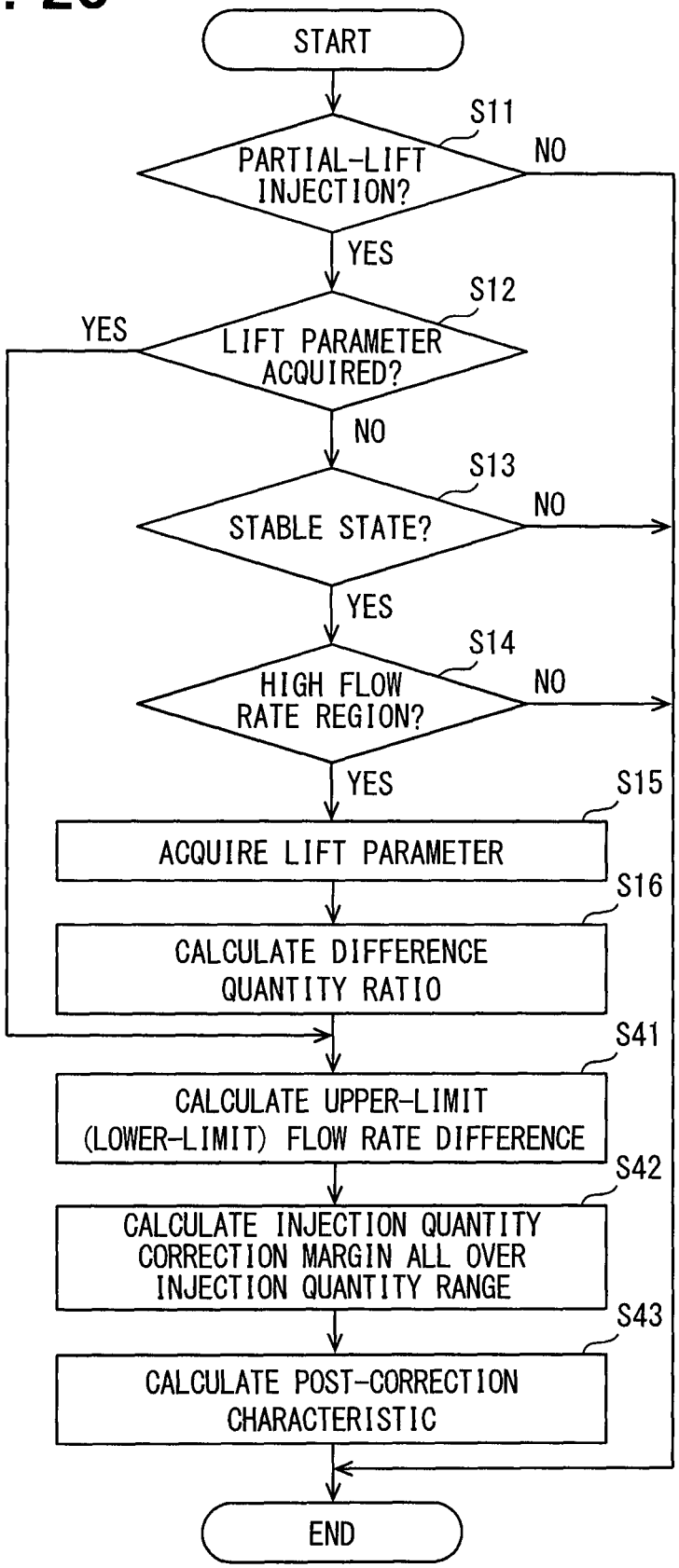
FIG. 20 is a flowchart illustrating a procedure of fuel injection control according to the fourth embodiment.

FIG. 20 is a flowchart illustrating a procedure of fuel injection control. The ECU 40 periodically implements this process, for example. This process replaces the above-mentioned process in FIG. 11. In FIG. 20, the same process as in FIG. 11 is given the same step number and the description is omitted for simplicity.

Steps S11 to S16 in FIG. 20 provide the same process as in FIG. 11. Steps S11 to S16 calculate a difference quantity ratio based on the lift parameter when the partial-lift injection is implemented.

In step S41, the process calculates an upper-limit flow rate difference or a lower-limit flow rate difference, namely, an injection quantity difference between the nominal characteristic and the upper limit characteristic or the lower limit characteristic with regard to a plurality of energization times all over the energization time range in the partial-lift region. In step S42, the process uses the flow rate difference and the difference quantity ratio to calculate injection quantity correction margin ΔQ all over the energization time range in the partial-lift region. In step S43, the process uses injection quantity correction margin ΔQ with regard to a plurality of energization times all over the energization time range in the partial-lift region to update the nominal characteristic. Thereby, the post-correction characteristic is calculated.

As above, the present embodiment can update the injection quantity correlation data used for the partial-lift region based on the difference quantity ratio calculated during operation of the partial-lift injection. It is possible to appropriately control the fuel injection quantity based on the data update. The correction process is implemented in a wide range of injection at a time by updating (rewriting) the map data, for example. It is possible to reduce loads on the correction calculation.

Other Embodiments

The above-mentioned embodiments may be modified as follows.

The valve element 34 generates a linking force when the valve element 34 accidentally reaches the full-lift position during operation of the partial-lift injection. In such a case, the requested partial-lift injection characteristic is likely to be unavailable. The valve element 34 may accidentally reach the full-lift position when the partial-lift injection is implemented for the high flow rate region in the partial-lift region, for example.

When the partial-lift injection is implemented, the ECU 40 determines whether the valve element 34 reaches the full-lift position after the start of energization on the fuel injection valve 30. The ECU 40 invalidates one of the operations such as the acquisition of the actual lift characteristic and the injection quantity correction when it is determined that the valve element 34 reaches the full-lift position.

Figure 21:
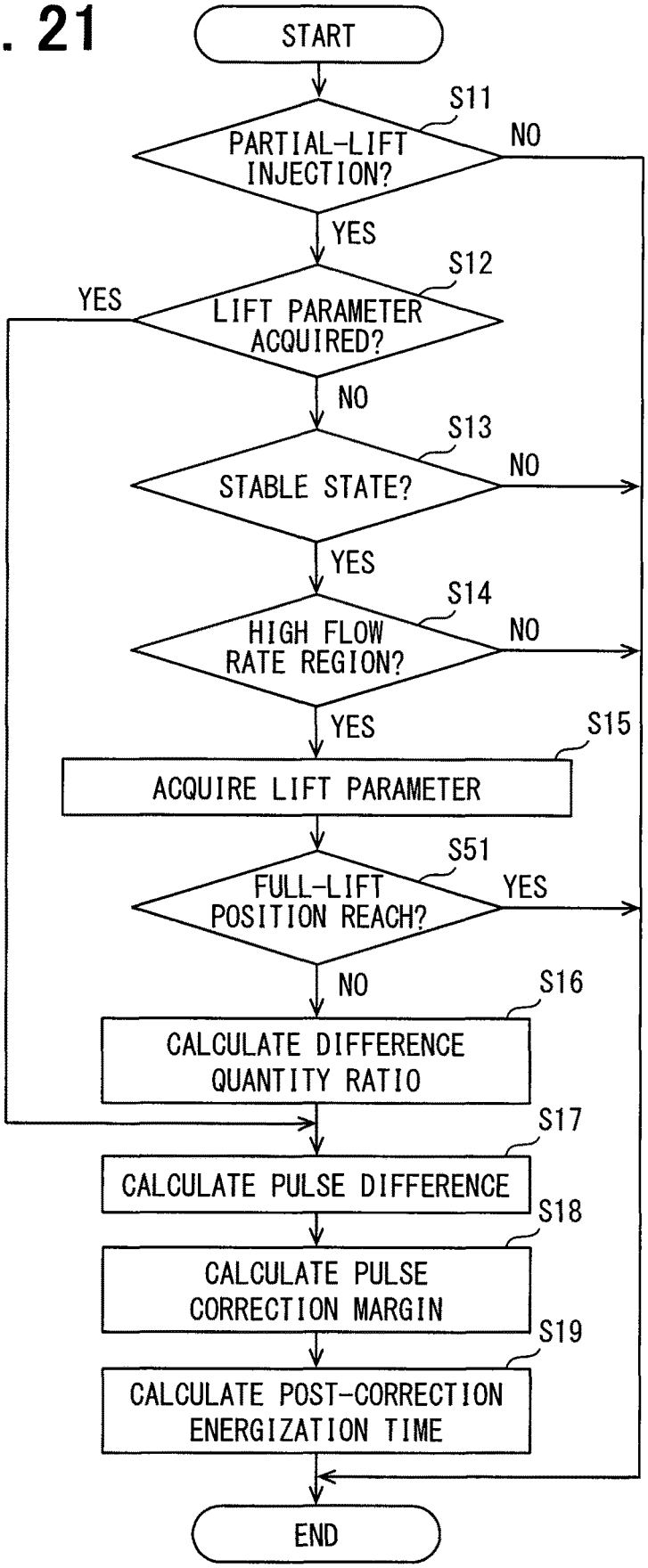
FIG. 21 is a flowchart illustrating a procedure of fuel injection control according to another example.

Specifically, the ECU 40 implements a process in FIG. 21. This process is provided as a partial modification of the process in FIG. 11. In FIG. 21, when the partial-lift injection is implemented in the high flow rate region in the partial-lift region, the ECU 40 acquires the lift parameter for the fuel injection valve 30 and proceeds to step S51. In step S51, the process determines whether the valve element 34 reaches the full-lift position during the current valve element lift. It is advisable to use a change in the coil energization current to determine whether the valve element 34 reaches the full-lift position, for example. Namely, the coil energization current is used to determine a valve element behavior resulting from the condition that the valve element 34 reaches the full-lift position. Alternatively, a contact-type sensor may be provided at the full-lift position for the valve element 34 of the fuel injection valve 30. A lift sensor may detect the valve element lift quantity. These sensors may detect that the valve element 34 reaches the full-lift position.

If step S51 results in NO, the process proceeds to step S16. If step S51 results in YES, the process terminates. If step S51 results in YES, the valve element 34 reaches the full-lift position. Then, the currently acquired lift parameter is invalidated. The determination in step S51 may be implemented at other timing such as between steps S14 and S15. The determination in step S52 may be implemented after step S18 in order to invalidate the injection quantity correction after the injection quantity correction is implemented.

The acquisition of the actual lift characteristic or the injection quantity correction is invalidated when it is determined that the valve element 34 reaches the full-lift position. It is possible to inhibit the accuracy of the fuel injection quantity control from degrading.

The above-mentioned embodiments acquire the injection-valve closing timing for the valve element 34 as the lift parameter but may be changed. The injection-valve opening timing for the valve element 34 or an injection-valve opening period from injection-valve opening to injection-valve closing may be acquired as the lift parameter, for example.

A lift sensor may detect the lifting behavior of the valve element 34 in the fuel injection valve 30, for example. The detection result may be acquired as the actual lift characteristic.

An actual lift characteristic (lift parameter such as the injection-valve closing timing) may be acquired during operation of the partial-lift injection. The injection quantity of the partial-lift injection may be corrected based on the actual lift characteristic. In addition, an actual lift characteristic (lift parameter such as the injection-valve closing timing) may be acquired during operation of the full-lift injection. The injection quantity of the partial-lift injection may be corrected based on the actual lift characteristic. For example, when no actual lift characteristic is acquired during the partial-lift injection, the ECU 40 corrects the injection quantity of the partial-lift injection based on the actual lift characteristic in the full-lift injection. A correction quantity (such as a pulse correction quantity) calculated based on the actual lift characteristic in the partial-lift injection may be changed based on the actual lift characteristic in the full-lift injection.

The partial-lift injection control is applicable to diesel engines as well as gasoline engines. Namely, the above-mentioned partial-lift injection control may be implemented on fuel injection valves for diesel engines.

The present disclosure has been described with reference to the embodiments but is not limited to the embodiments and structures. The present disclosure covers various modification examples and modifications within a commensurate scope. In addition, the category or the scope of the idea of the present disclosure covers various combinations or forms and moreover the other combinations or forms including only one element or more or less in the former.

The invention claimed is:

1. A fuel injection control device for an internal combustion engine including a fuel injection valve, the fuel injection control device configured to cause a valve element to open to inject fuel in conjunction with energization of the fuel injection valve, the fuel injection control device comprising:

a processor; and a memory configured to store computer readable instructions that, when executed by the processor, cause the fuel injection control device to:

implement partial-lift injection to open the fuel injection valve by an energization time such that the valve element does not reach a full-lift position;

acquire, as an actual lift characteristic, an actual lifting behavior of the valve element when the partial-lift injection is implemented;

compare the acquired actual lift characteristic with a predetermined reference characteristic and correct a fuel injection quantity in the partial-lift injection based on a result of the comparison; and determine whether the partial-lift injection is implemented in a specified high flow rate region in a partial-lift region in which the partial-lift injection is implemented, wherein the fuel injection device is further caused to:

acquire the actual lift characteristic in response to determining that the partial-lift injection is implemented in the specified high flow rate region in the partial-lift region;

implement injection quantity correction based on the actual lift characteristic acquired during the partial-lift injection in the high flow rate region; and when the partial-lift injection is implemented in a low flow region in which a flow rate is lower than a flow rate in the high flow rate region, implement injection quantity correction based on the actual lift characteristic acquired in the high flow rate region during the partial-lift injection and a result of comparison between the reference characteristic and the actual lift characteristic acquired in the high flow rate region during the partial-lift injection, wherein the fuel injection device is further caused to:

acquire, as the actual lift characteristic, a lift parameter corresponding to an energization time for the fuel injection valve and in accordance with a lifting behavior of the valve element resulting from a start and an end of energization of the fuel injection valve;

calculate a characteristic difference from the reference characteristic by using a lift correlation data and based on the energization time in a current partial-lift injection and the lift parameter that is acquired, the lift correlation data defining a relationship between the energization time and the lift parameter in the partial-lift region in which the partial-lift injection is implemented, and the lift correlation data defining, as the relationship between the energization time and the lift parameter, a nominal characteristic, which is the reference characteristic, and a limitation characteristic representing at least one of an upper limit characteristic to which the lift parameter increases and a lower limit characteristic to which the lift parameter decreases;

calculate, as the characteristic difference, a difference quantity ratio with respect to the nominal characteristic based on a position of the actual lift characteristic between the nominal characteristic and the limitation characteristic; and implement injection quantity correction based on the difference quantity ratio.

2. The fuel injection control device according to claim 1, wherein a lift parameter is acquired as the actual lift characteristic based on one of a voltage applied to the fuel injection valve and an energization current flowing through the fuel injection valve corresponding to an energization time for the fuel injection valve, and the lift parameter is in accordance with a lifting behavior of the valve element resulting from a start and an end of energization of the fuel injection valve.

3. The fuel injection control device according to claim 1, wherein the fuel injection device is further caused to:

determine whether the valve element reaches the full-lift position after energization of the fuel injection valve starts when the partial-lift injection is implemented; and on determination that the valve element reaches the full-lift position, to invalidate one of:

acquisition of the actual lift characteristic; and implementation of the injection quantity correction.

4. The fuel injection control device according to claim 1, wherein the fuel injection device is further caused to:

calculate a difference margin of the energization time with respect to the reference characteristic by using injection quantity correlation data and based on the characteristic difference, the injection quantity correlation data defining a relationship between the energization time and an injection quantity in the partial-lift region, and correct the energization time based on the difference margin of the energization time to implement the injection quantity correction.

5. The fuel injection control device according to claim 1, wherein the fuel injection device is further caused to:

calculate a difference margin of the injection quantity with respect to the reference characteristic by using injection quantity correlation data and based on the characteristic difference, the injection quantity correlation data defining a relationship between the energization time and an injection quantity in the partial-lift region, and correct the energization time based on the difference margin of the injection quantity to implement the injection quantity correction.

6. The fuel injection control device according to claim 1, wherein the fuel injection device is further caused to:

drive the fuel injection valve by using injection quantity correlation data and based on an energization time calculated in accordance with a required injection quantity, the injection quantity correlation data defining a relationship between the energization time and an injection quantity in the partial-lift region;

calculate difference margins of the energization time for a plurality of injection quantities with respect to the reference characteristic based on the characteristic difference in the injection quantity correlation data; and update the injection quantity correlation data based on the difference margins of the energization time to implement the injection quantity correction.

7. The fuel injection control device according to claim 1, wherein the fuel injection device is further caused to:

drive the fuel injection valve by using injection quantity correlation data and based on an energization time calculated in accordance with a required injection quantity, the injection quantity correlation data defining a relationship between the energization time and an injection quantity in the partial-lift regions;

calculate difference margins of the injection quantity for a plurality of energization times with reference to the reference characteristic based on the characteristic difference in the injection quantity correlation data; and update the injection quantity correlation data based on the difference margins of the injection quantity to implement the injection quantity correction.

8. A fuel injection control device for an internal combustion engine including a fuel injection valve, the fuel injection control device configured to cause a valve element to open to inject fuel in conjunction with energization of the fuel injection valve, the fuel injection control device comprising:

a processor; and a memory configured to store computer readable instructions that, when executed by the processor, cause the fuel injection control device to:

implement partial-lift injection to open the fuel injection valve by an energization time such that the valve element does not reach a full-lift position;

acquire, as an actual lift characteristic, an actual lifting behavior of the valve element when the partial-lift injection is implemented;

compare the acquired actual lift characteristic with a predetermined reference characteristic and correct a fuel injection quantity in the partial-lift injection based on a result of the comparison; and acquire, as the actual lift characteristic, a lift parameter corresponding to an energization time for the fuel injection valve and in accordance with a lifting behavior of the valve element resulting from a start and an end of energization of the fuel injection valve, wherein the fuel injection device is further caused to:

calculate a characteristic difference from the reference characteristic by using a lift correlation data and based on the energization time in a current partial-lift injection and the acquired lift parameter, the lift correlation data defining a relationship between the energization time and the lift parameter in a partial-lift region in which the partial-lift injection is implemented; and injection quantity correction based on the characteristic difference, wherein the lift correlation data defines, as a relationship between the energization time and the lift parameter, a nominal characteristic, which is the reference characteristic, and a limitation characteristic representing at least one of an upper limit characteristic to which the lift parameter increases and a lower limit characteristic to which the lift parameter decreases, the fuel injection device is further caused to:

calculate, as the characteristic difference, a difference quantity ratio with respect to the nominal characteristic based on a position of the actual lift characteristic between the nominal characteristic and the limitation characteristic, and implement the injection quantity correction based on the difference quantity ratio.

9. The fuel injection control device according to claim 8, wherein the fuel injection device is further caused to:

calculate a difference margin of the energization time with respect to the reference characteristic by using injection quantity correlation data and based on the characteristic difference, the injection quantity correlation data defining a relationship between the energization time and an injection quantity in the partial-lift region; and correct the energization time based on the difference margin of the energization time to implement the injection quantity correction.

10. The fuel injection control device according to claim 8, wherein the fuel injection device is further caused to:

calculate a difference margin of the injection quantity with respect to the reference characteristic by using injection quantity correlation data and based on the characteristic difference, the injection quantity correlation data defining a relationship between the energization time and an injection quantity in the partial-lift region; and correct the energization time based on the difference margin of the injection quantity to implement the injection quantity correction.

11. The fuel injection control device according to claim 8, wherein the fuel injection device is further caused to:

drive the fuel injection valve by using injection quantity correlation data and based on an energization time calculated in accordance with a required injection quantity, the injection quantity correlation data defining a relationship between the energization time and an injection quantity in the partial-lift region;

calculate difference margins of the energization time for a plurality of injection quantities with respect to the reference characteristic based on the characteristic difference in the injection quantity correlation data; and update the injection quantity correlation data based on the difference margins of the energization time to implement the injection quantity correction.

12. The fuel injection control device according to claim 8, wherein the fuel injection device is further caused to:

drive the fuel injection valve by using injection quantity correlation data and based on an energization time calculated in accordance with a required injection quantity, the injection quantity correlation data defining a relationship between the energization time and an injection quantity in the partial-lift regions;

calculate difference margins of the injection quantity for a plurality of energization times with reference to the reference characteristic based on the characteristic difference in the injection quantity correlation data; and update the injection quantity correlation data based on the difference margins of the injection quantity to implement the injection quantity correction.

13. A fuel injection control device for an internal combustion engine including a fuel injection valve, the fuel injection control device configured to cause a valve element to open to inject fuel in conjunction with energization of the fuel injection valve, the fuel injection control device comprising:

a processor; and a memory configured to store computer readable instructions that, when executed by the processor, cause the fuel injection control device to:

implement partial-lift injection to open the fuel injection valve by an energization time such that the valve element does not reach a full-lift position;

acquire, as an actual lift characteristic, an actual lifting behavior of the valve element when the partial-lift injection is implemented;

compare the acquired actual lift characteristic with a predetermined reference characteristic and correct a fuel injection quantity in the partial-lift injection based on a result of the comparison; and determine whether the partial-lift injection is implemented in a specified high flow rate region in a partial-lift region in which the partial-lift injection is implemented, wherein the fuel injection device is further caused to:

acquire the actual lift characteristic in response to determining that the partial-lift injection is implemented in the specified high flow rate region in the partial-lift region;

implement injection quantity correction based on the actual lift characteristic acquired during the partial-lift injection in the high flow rate region; and when the partial-lift injection is implemented in a low flow region in which a flow rate is lower than a flow rate in the high flow rate region, implement injection quantity correction based on the actual lift characteristic acquired in the high flow rate region during the partial-lift injection and a result of comparison between the reference characteristic and the actual lift characteristic acquired in the high flow rate region during the partial-lift injection, wherein the fuel injection device is further caused to determine that the partial-lift injection is implemented in the specified high flow rate region on determining that the energization time is larger than or equal to a specified value.

14. The fuel injection control device according to claim 13, wherein the specified value is set to one of ½, ⅔, or ¾ of a maximum energization time defined as the partial-lift region.

* * * * *